US008029032B1

(12) United States Patent
Yang

(10) Patent No.: US 8,029,032 B1
(45) Date of Patent: Oct. 4, 2011

(54) AUTOMOTIVE DOOR HANDLE ASSEMBLY WITH DIRECTLY COUPLED-INERTIA ACTIVATED MECHANISM

(76) Inventor: Lei Yang, Novi, MI (US)

( * ) Notice: Subject to any disclaimer, the term of this patent is extended or adjusted under 35 U.S.C. 154(b) by 0 days.

(21) Appl. No.: 12/151,013

(22) Filed: May 3, 2008

Related U.S. Application Data

(63) Continuation of application No. 12/012,329, filed on Feb. 1, 2008, now abandoned.

(51) Int. Cl.
*E05B 3/00* (2006.01)

(52) U.S. Cl. ..... 292/336.3; 292/DIG. 22

(58) Field of Classification Search ..... 292/336.3, 292/DIG. 22, DIG. 8, DIG. 31, 347, 348
See application file for complete search history.

(56) References Cited

U.S. PATENT DOCUMENTS 3,719,248 A * 3/1973 Breitschwerdt et al. ..... 180/271
5,743,575 A * 4/1998 McFarland ..... 292/336.3
6,070,923 A 6/2000 Tanimoto
6,367,124 B1 * 4/2002 Bella et al. ..... 292/336.3
6,460,904 B1 * 10/2002 Stapf ..... 292/336.3
6,719,336 B2 4/2004 Sato
6,874,829 B2 * 4/2005 Muller ..... 292/336.3
7,070,216 B2 7/2006 von zur Muehlen
7,198,307 B2 4/2007 Drysdale
7,201,405 B2 * 4/2007 Le et al. ..... 292/93
7,210,716 B2 * 5/2007 Mueller et al. ..... 292/336.3
7,232,164 B2 6/2007 Lee

FOREIGN PATENT DOCUMENTS

WO WO2005/106167 A1 11/2005

* cited by examiner

*Primary Examiner* — Carlos Lugo
*Assistant Examiner* — Mark Williams

(57) ABSTRACT

A directly coupled-inertia activated mechanism that may be incorporated into a door handle assembly and counteracts inadvertent door opening during a side crash. An inertia lever with certain inertia moment in relation ship to that of the handle is coupled to the handle, such that it rotates in the opposite direction of that of the handle when the handle is being pulled. The inertia lever is capable of canceling totally the inertia force causing the handle to move inadvertently to unlatched position during side impact crash, and stops the handle's unlatching move.

10 Claims, 30 Drawing Sheets

Detail A

AUTOMOTIVE DOOR HANDLE ASSEMBLY WITH DIRECTLY COUPLED-INERTIA ACTIVATED MECHANISM

CROSS-REFERENCE TO RELATED APPLICATION

This is a continuation of application Ser. No. 12/012,329, filed on Feb. 1, 2008, now abandoned.

FIELD OF INVENTION

The invention relates generally to the door release system of automotive vehicle, and in particular to a safety device in a door handle assembly as prevention of inadvertent opening of the door during crash, in particular side impact crash.

BACKGROUND OF THE INVENTION

Automotive vehicles can be involved in crash accident. In particular side crash can cause the handle to move inadvertently to unlatched position. Doors are unlatched and swung open, thus occupants are exposed to greater risk of being expelled from the vehicles. Many mandatory side crash tests are set up for vehicles. One requirement of these tests is that the vehicle doors remain closed during and after side crash test, in which the vehicle is hit from side. To measure side crash severity, acceleration in terms of G, (1 G=9.8 m/sec^2) is used. Very often, side crash is very severe that acceleration can be as high as 200 G in a very short of time interval. In side crash test, the acceleration is a spatial vector with lateral component parallel to the side impact, and vertical component perpendicular to the side impact. It is also a random time sequence, varies with the time.

Typically, a safety device against inadvertent move of the handle uses a counterweight mounted in the exterior handle assembly to reduce or to stop the handle move during side crash, because the counterweight's move under the inertia force makes the handle to move against the inertia force on the handle. One of the widely used design is to integrate counter weight into bell crank lever with a certain offset to the lever's pivot, such that the inertia force on the counter weight make the bell crank lever move against the handle's move under the inertia force. The bell crank lever transfers the handle's move and unlatches the latch. Or the counter weight can be a separate component, as described in the U.S. Pat. No. 7,070,216 B2. However, when the acceleration of the side crash is very high, e.g. 200 G, counterweight of suitable size fit into current automotive doors can not stop the handle from inadvertent move. Further when counterweight, which is integrated into the bell crank lever, is made large and heavy as required, it can easily overcome the spring bias and rotate to unlatch the latch under the vertical component of the inertia force, even that the exterior handle is not activated by the lateral component of the inertia force.

Additional components can be added to the door handle assembly as safety device, in which a component blocks the unlatching movement between the handle and the latch due to the inertia force, like the one mentioned in the U.S. Pat. No. 7,201,405 B2. However, it is highly possible and often the case that the handle already moves out passing a threshold and cause the latch to unlatch the door before this particular component begin to move as to block the handle's inadvertent movement. This is because that blocking component(s) and the handle have different dynamic behavior due to the acceleration nature of the side crash. Side crash has inertia force of spatial vector in orientation and random time sequence in magnitude. It is quite common that by the time a blocking component come into the engagement to block the unlatching movement, the component to be blocked/stopped has already gained some speed. The sudden block/stop induces very high stress on the blocking component and the one to be blocked, such that fatigue develops over the time. Eventually one or both of the components break.

SUMMARY OF THE INTERVENTION

The present invention is directed to a mechanism that counteracts inertia forces caused by a vehicle crash. The mechanism of the invention is also called directly coupled-inertia activated mechanism and may be incorporated into a door handle assembly of a vehicle. With one aspect of the invention, the directly coupled-inertia activated mechanism of the invention will compensate the inertia force on the door handle assembly, thus prevent the door handle assembly from unlatching the latch mechanism during a side crash. After the crash or when the crash force is removed, the directly coupled-inertia activated mechanism of the invention will allow the door handle assembly to function normally, thereby permitting the door to be opened and the occupants to exit from the vehicle.

DETAILED DESCRIPTION OF THE EMBODIMENTS

Figure 1:
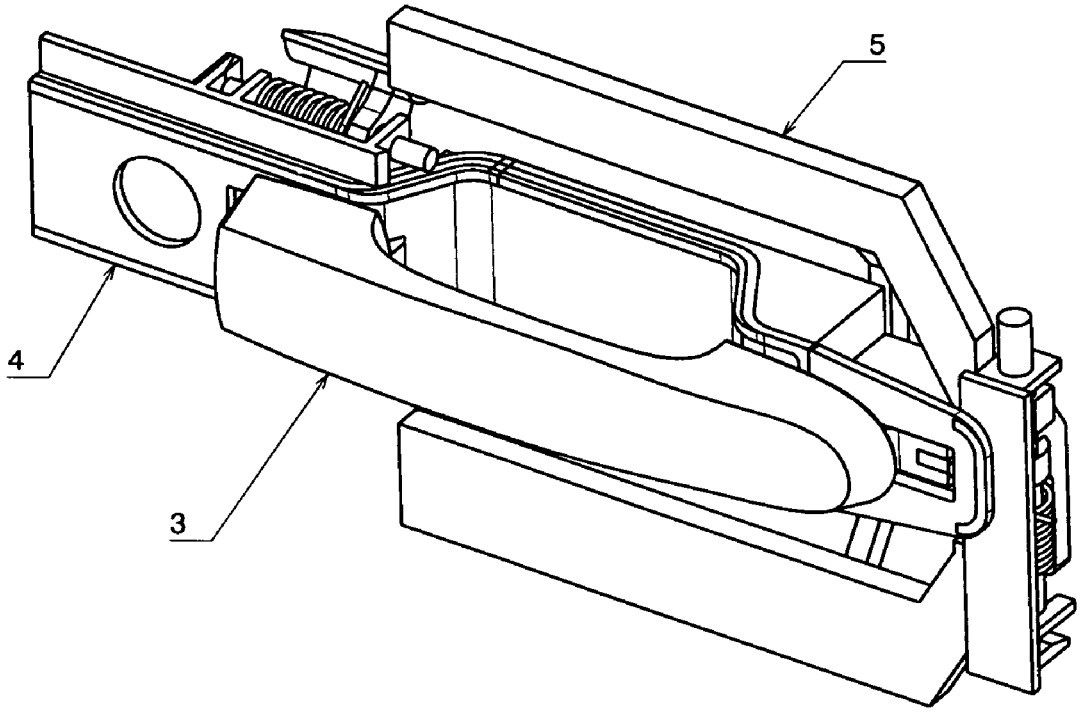
FIG. 1 is a perspective view of a door handle assembly incorporated with directly coupled-inertia activated mechanism according to an embodiment of the invention.
Figure 2:
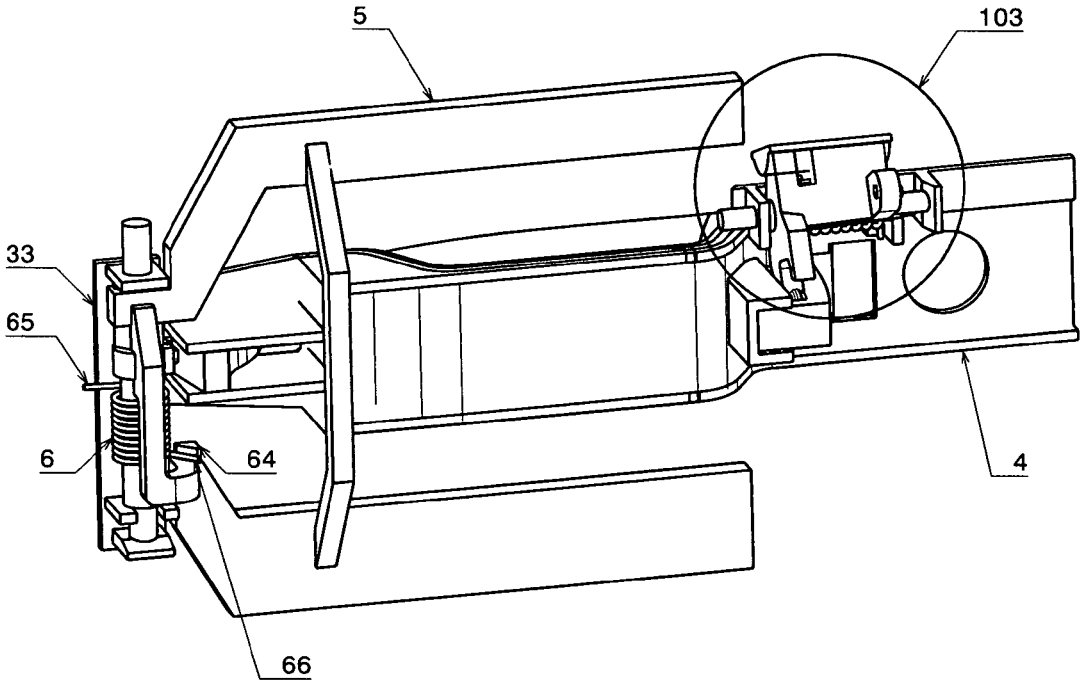
FIG. 2 is another perspective view of the door handle assembly of FIG. 1.

FIG. 1 and FIG. 2 show a door handle system 101 of a vehicle. It is connected to a latch system (not shown) through a connecting element (not shown), usually a rod or a cable. The door handle system 101, the latch system and the connecting element are installed in vehicle doors. The door handle system 101, the latch system and the connecting element keeps vehicle doors closed, and let vehicle doors open when activated. Activating the door handle assembly 101 by pulling its handle will unlatch the latch system and the vehicle door is unlatched and open.

The door handle assembly 101 also inhibits inadvertent opening of the door 1 when the vehicle is involved in a collision, particularly an impact on a side of the vehicle which results in acceleration and/or forces in a lateral as well as in a vertical direction.

Referring FIG. 1-4, the door handle assembly 101 comprises a handle 3, a chassis 4, a latch activation mechanism 103, an inertia lever 5 in one embodiment. The latch activation mechanism 103 comprises, but not limited to, a lever or bell crank lever named for distinguishing purpose, a spring or bell crank lever spring named for distinguishing purpose.

Figure 6:
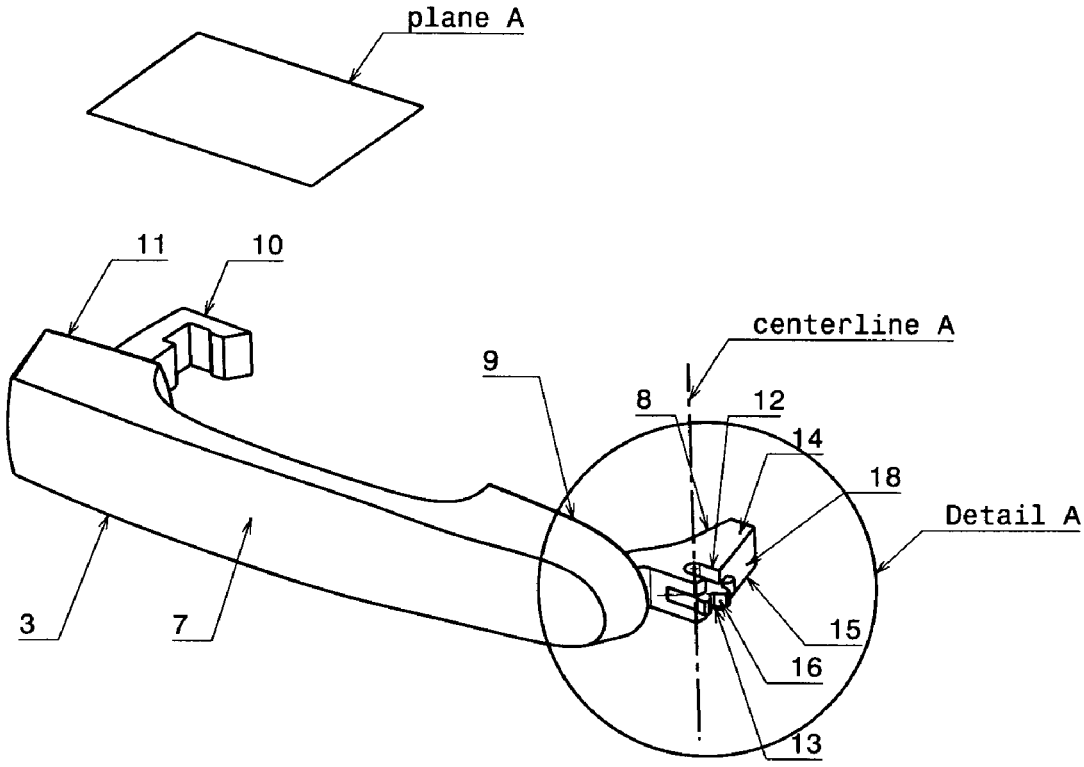
FIG. 6 is a perspective view of a handle with its features according to an embodiment of the invention.
Figure 7:
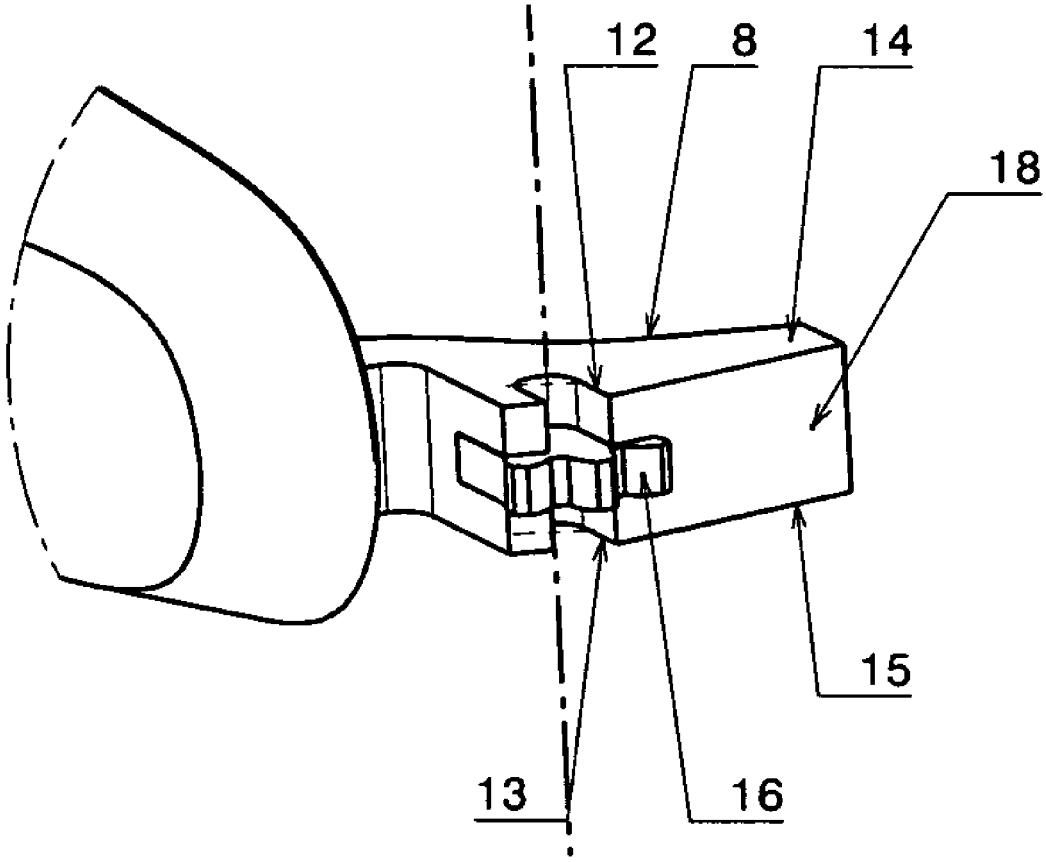
FIG. 7 is a detail view of the handle of FIG. 6.

Referring to FIG. 6, the handle 3 has a body 7 for grabbing by hand. It has a tail 8 at a first end 9, a hook 10 at a second, opposite end 11, both extend from the same side of the body 7. The centerline of the body 7, the tail 8 and the hook 10 forms a plane A. On the tail 8 there are 2 notches, a notch 12 on the side 14, a notch 13 on the side 15. The two notches 12 and 13 are co-centered. The centerline A of the notches 12, 13 is perpendicular to the plane A. In one embodiment, there is a plurality of teeth 16 on the tail 18 about the centerline A in one embodiment (FIG. 6, FIG. 7). The plurality of teeth 16 is selectively at the side 18 of the tail 8. The hook 12 takes a 'L' shape.

Figure 3:
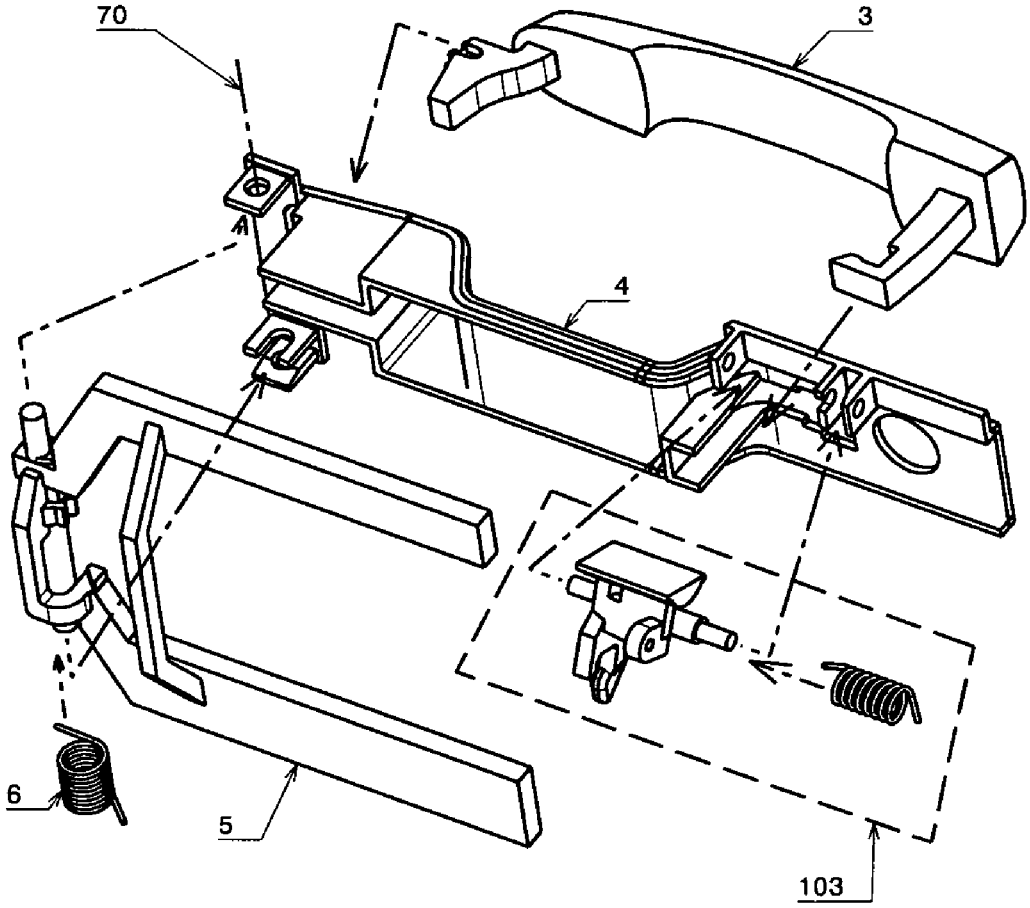
FIG. 3 is an exploded view of the door handle assembly of FIG. 1.
Figure 4:
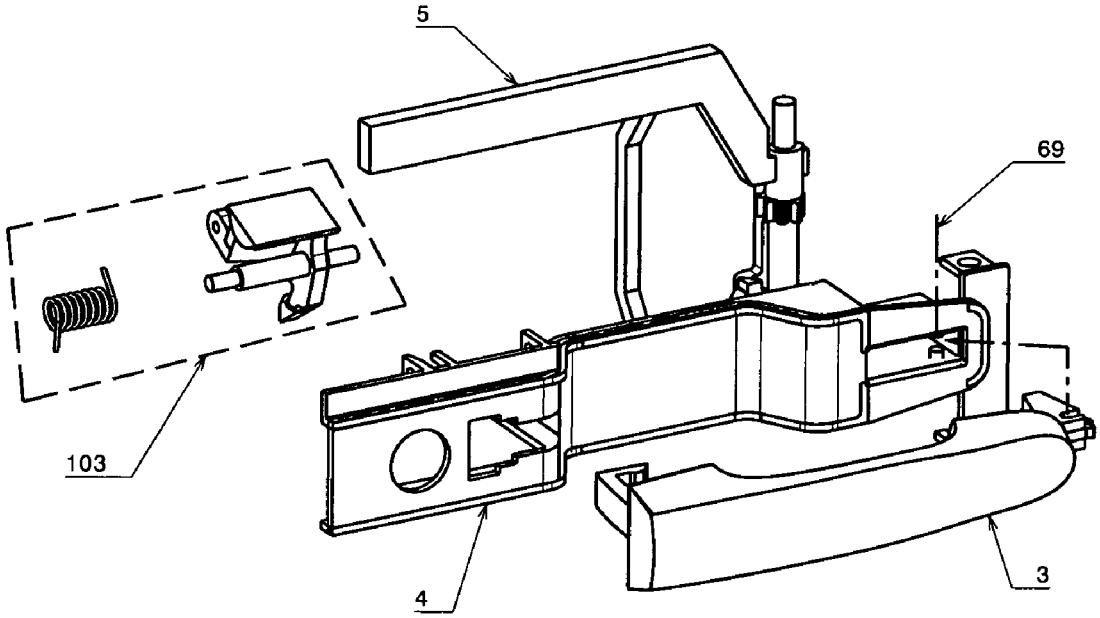
FIG. 4 is another exploded view of the door handle assembly of FIG. 1.
Figure 5:
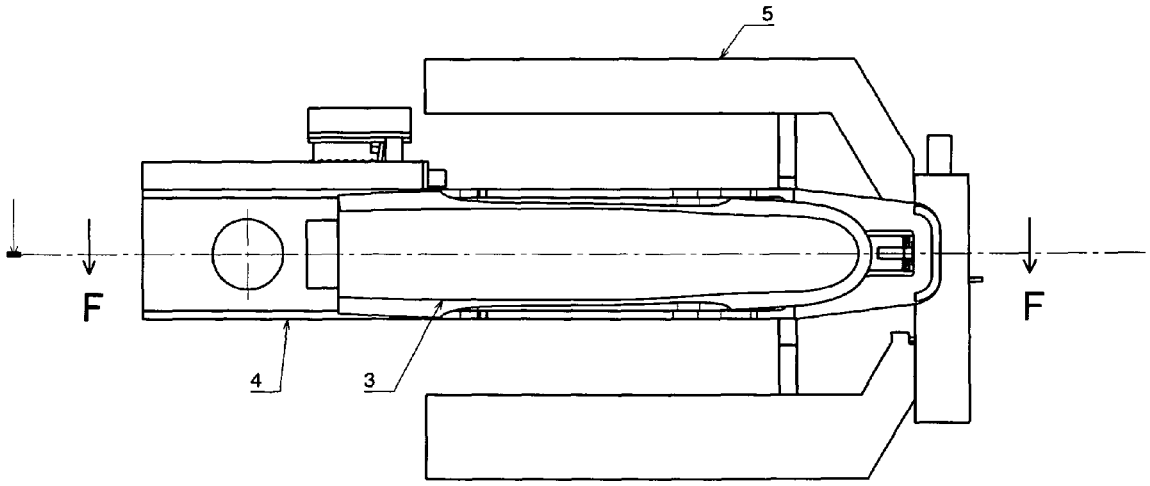
FIG. 5 is a side view of the door handle assembly of FIG. 1.
Figure 8:
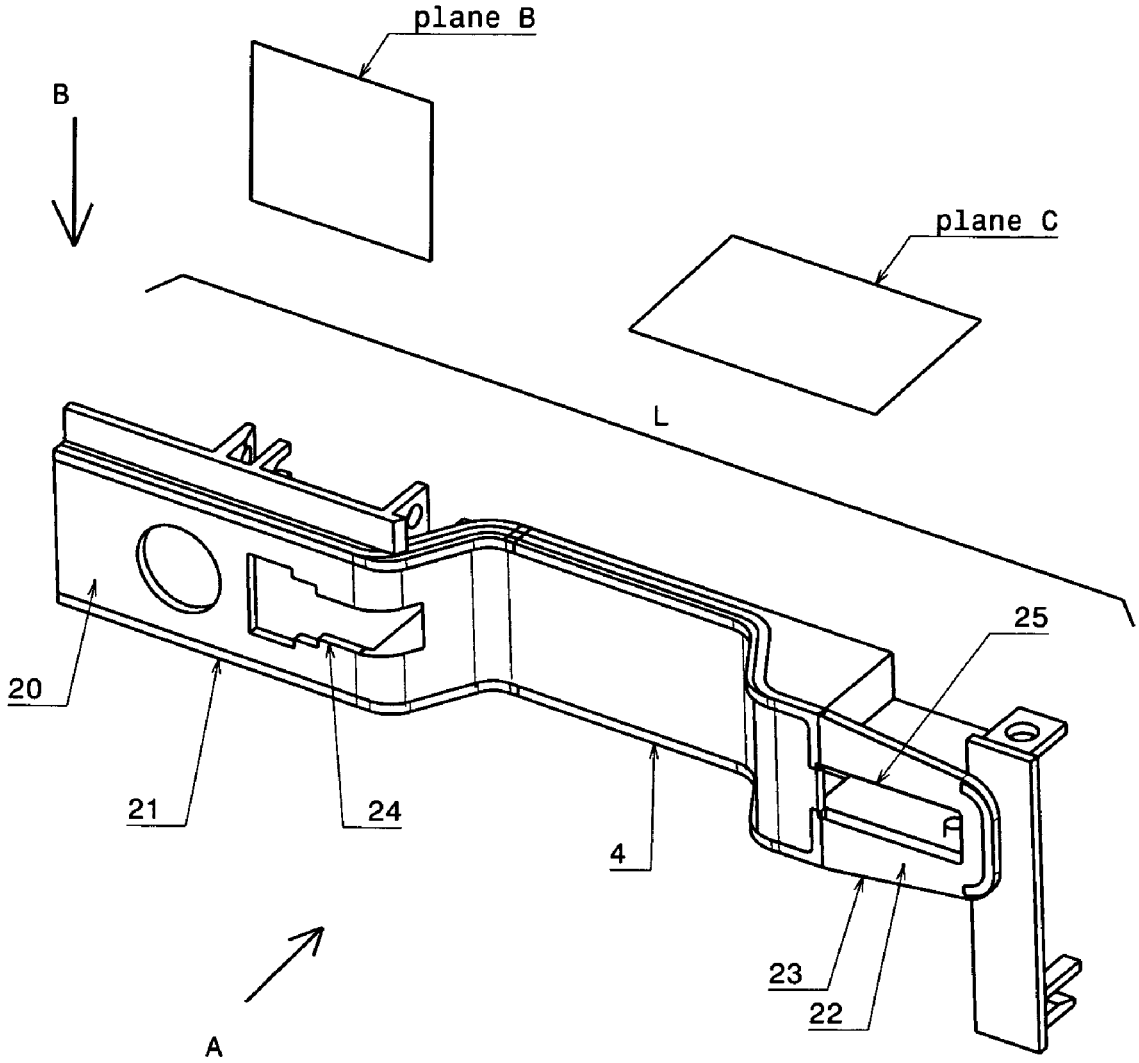
FIG. 8 is a perspective view of a chassis with its features according to an embodiment of the invention.
Figure 9:
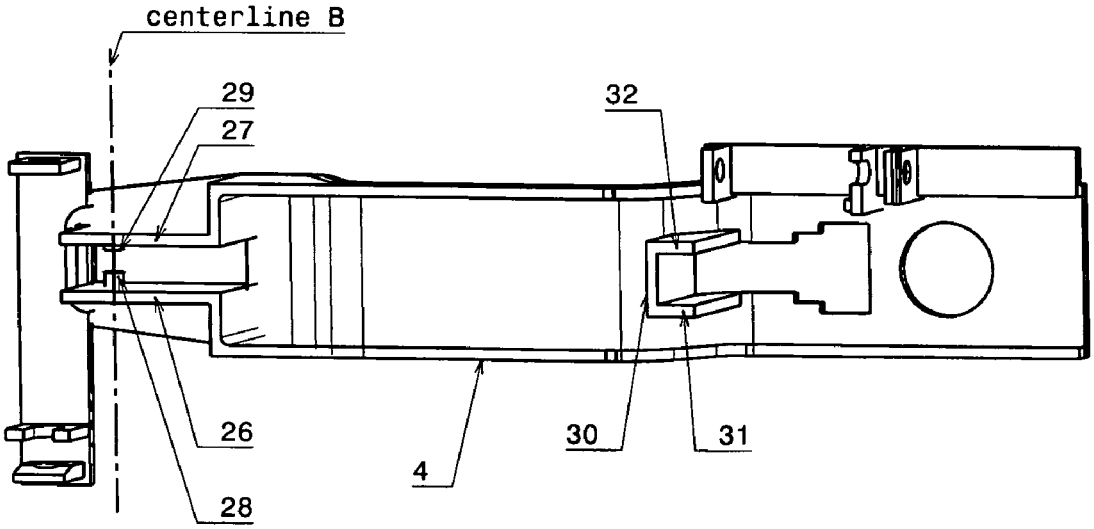
FIG. 9 is a perspective view of the chassis of FIG. 8.
Figure 10:
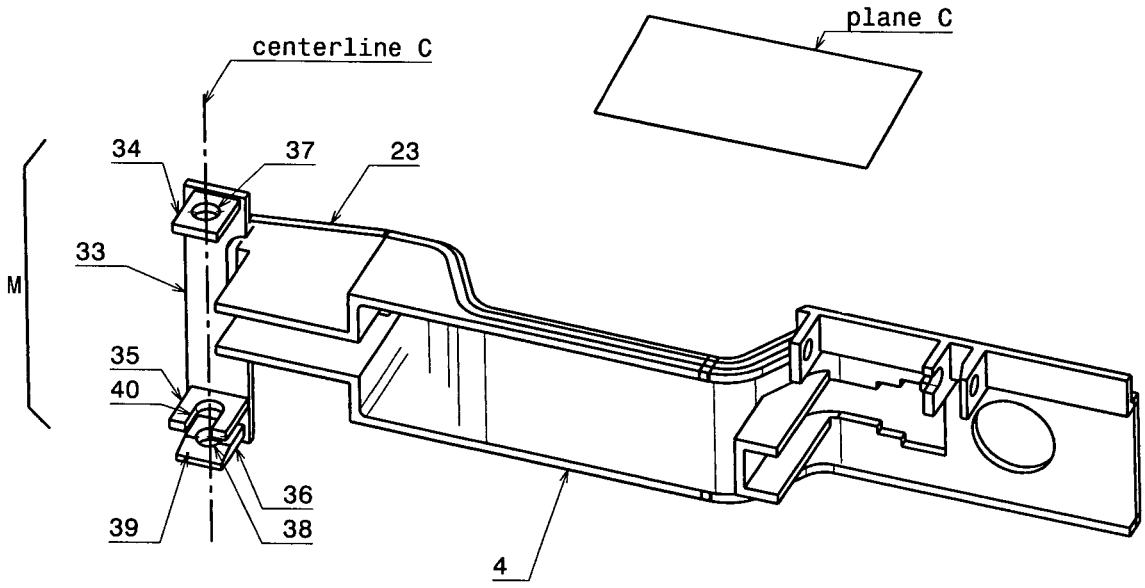
FIG. 10 is a perspective view of the chassis of FIG. 8.
Figure 14:
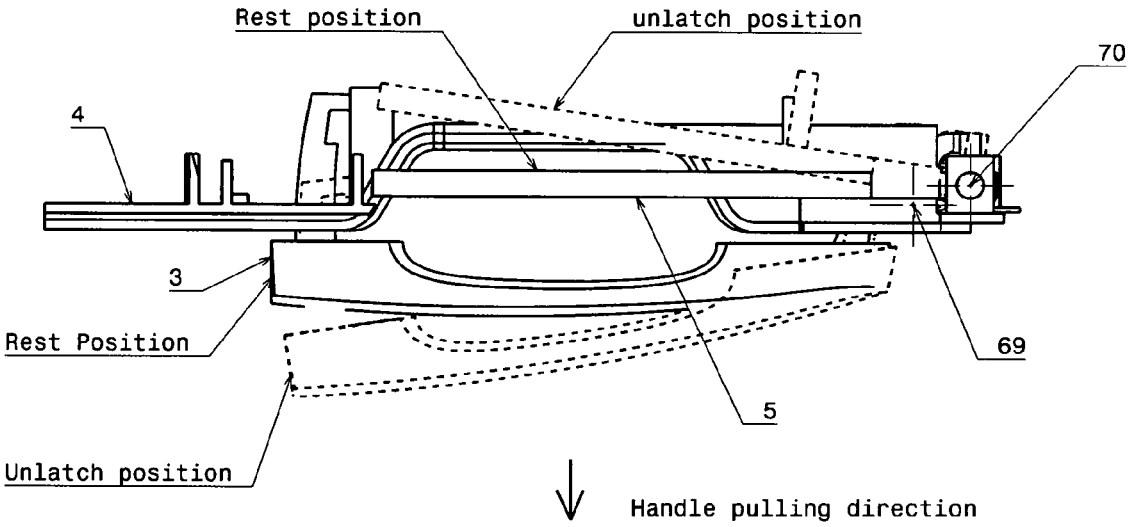
FIG. 14 is a top view of the door handle assembly with directly coupled-inertia activated mechanism showing resting position in solid lines, and unlatching position in dashed lines.

Referring to FIG. 8, FIG. 9 and FIG. 10, the chassis 4 takes a general rectangular shape from a view A, a 'C' shape from a view B, which is 90 degree to the view A. The face 20 on the end portion 21 and the face 22 on the opposite end portion 23 are parallel, particularly in the same plane B. When the door handle assembly is installed in the door 1, the end portion 21 is towards rear and close to the shut face of the door 1, and the face 21, 23 are fastened against the sheet metal of the door 1. A plane C perpendicular to the plane B, parallel to one dimension L of the chassis 4 defines the center plane. There are an opening 24 in the end portion 21, an opening 25 in the end portion 23. The centerline of both openings lie in the plane C. The opening 25 has wall 26, 27, which are parallel to the plane C, extended to the same side as the middle portion of the 'C' shape. On the wall 26 there is a post 28; on the wall 27 there is a post 29. The post 28 and 29 are co-centered, and the centerline B of the post 28, 29 is perpendicular to the plane C. There is a 'C' shaped wall 30 on the opening 24, more specifically on the end of the opening 24 towards the end 23. The wall 30 extends to the same side as of the wall 26, 27. The wall 31, 32 of the wall 30 are on the two opposite sides of the opening 24, parallel to the plane C. When the handle 3 is installed in the chassis 4, the tail 8 goes through the face 22 and the opening 25, the hook 10 goes through the face 20 and the opening 24. The notches 12, 13 are seated to the posts 28, 29. After installation, the handle 3 can rotate about the centerline A between a rest position and a unlatch position with the hook 10 sliding between the wall 31, 32 (FIG. 14). The hook 10 engages and activates the latch activation mechanism 103, as understood by those skilled in the art (FIG. 3 and FIG. 4).

Referring to FIG. 10, there is a bracket 33 at the end of the end portion 23, with a selective rectangular shape in one embodiment. One of its dimensions M is selectively perpendicular to the plane C. There are walls 34, 35, 36 on the bracket 33, parallel to the plane C in general. The wall 34 is on one side of the plane C, the wall 36 is on the opposite side, both on the same side of the bracket 33. There is a hole 37 on the wall 34. There is a hole 38 on the wall 36. The hole 37 and the hole 38 are co-centered, and the centerline C of the hole 37, 38 is perpendicular to the plane C. The wall 35 is between the wall 34 and 36, close to the wall 36, on the same side of the bracket 33 as the wall 34 and 36. There is a notch 40 on the wall 35, centered to the centerline C. The notch 40 is selectively opened in a direction perpendicular the plane B, towards the same side of the plane B as the wall 26, 27. There is a chamfer 39 on the wall 36 towards the wall 35, parallel to the dimension L.

Figure 15:
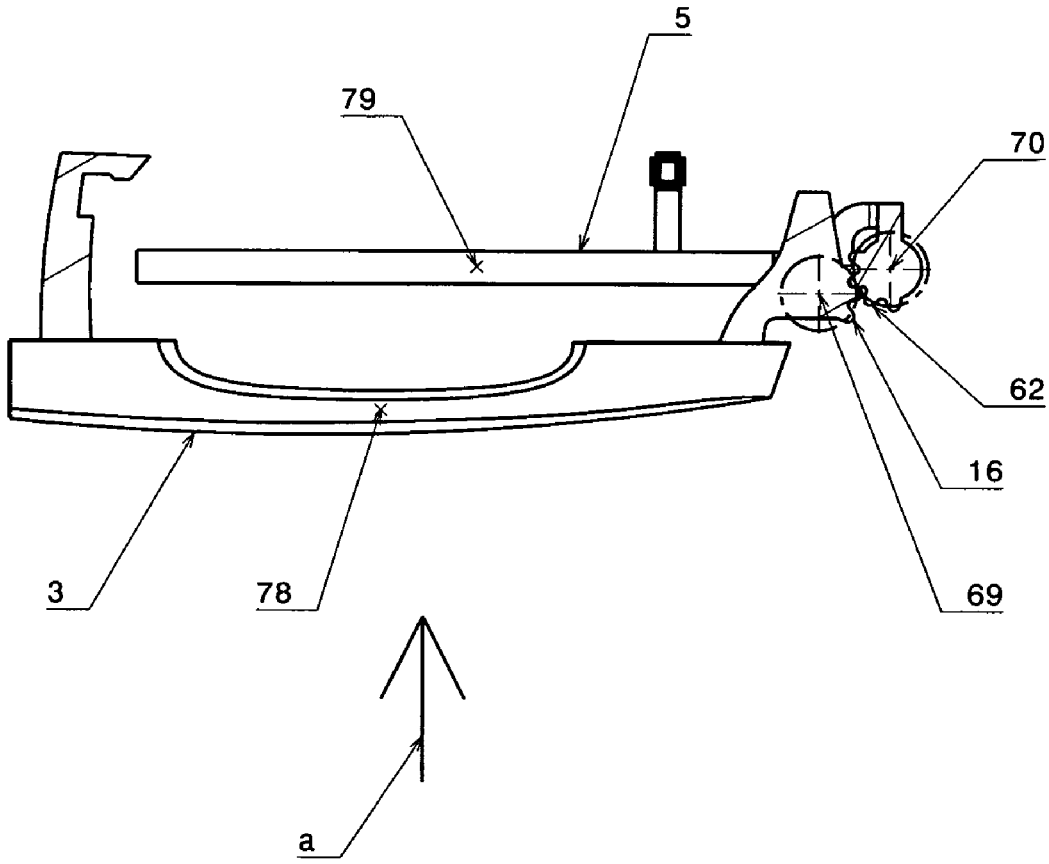
FIG. 15 is a top view of the door handle assembly showing the handle and the inertia lever being installed.

When the handle 3 is installed onto the chassis 4, the notches 12, 13 catch the posts 28, 29 of the chassis 4, forming a pivot axis 69. The centerline A and the centerline B overlap each other. Pivot axis 69 is in line with both the centerline A and the centerline B. Thus the handle 3 is pivotally supported on the chassis 4, with the majority of it, including body 7, appearing in the general area between the end portion 21 and the end portion 23 of the chassis 4 (FIG. 3, FIG. 4). This indicates that the center of mass 78 of the handle 3 is to the left of the pivot axle 69 (FIG. 15).

Figure 11:
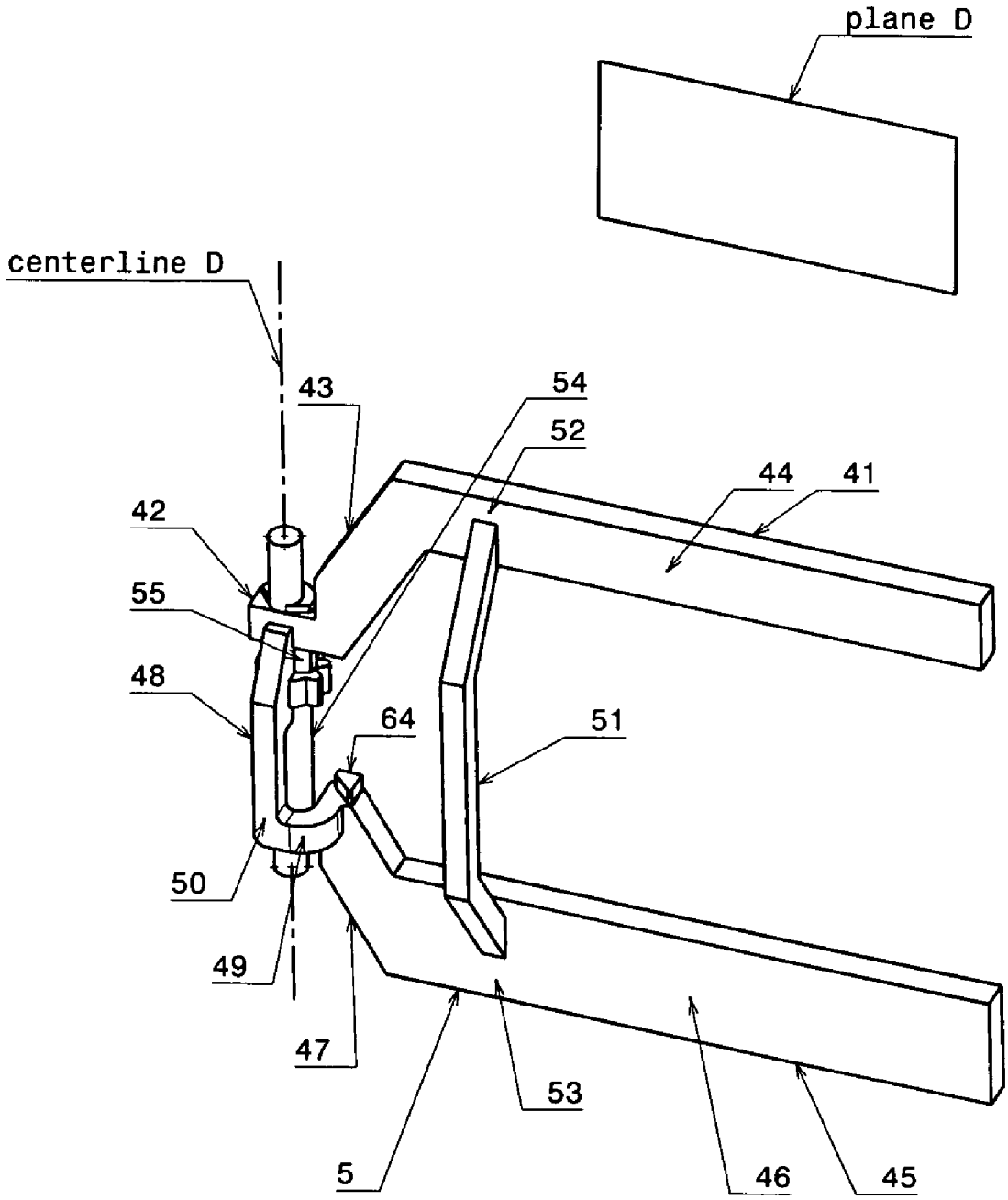
FIG. 11 is a perspective view of an inertia lever with its features according to one embodiment of the invention.
Figure 12:
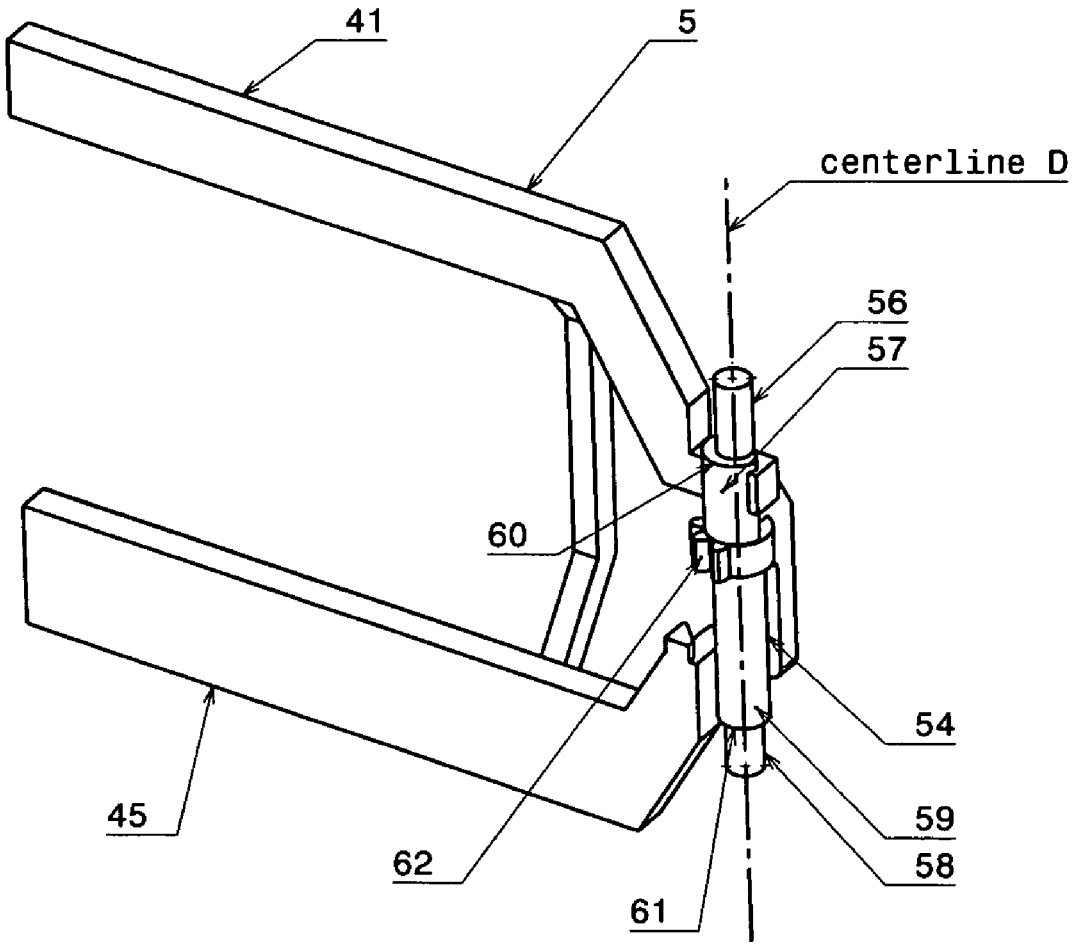
FIG. 12 is a perspective view of the inertia lever of FIG. 11.

Referring to FIG. 11 and FIG. 12, the inertia lever 5 has a first 'L' shaped member 41, with a selective extension 42 at the end 43 parallel to its main body 44. It has a selective second 'L,' shaped member 45 with a main body 46 and an end 47. The members 41 and 45 are connected together by a third member 48 on one side of the extension 42 and the same side of the end 47. The main body 44 of the member 41 and the main body 46 of the member 45 are selectively in parallel to each other, both form a plane D. The member 48 has an 'L' shaped structure 49 at the end 50, which connects to the end 47. A forth member 51 of a selective 'C' shape joins the member 41 at a position 52, the member 45 at a position 53, on the same side as of the member 48. The member 51 is selectively parallel to the member 48. A selective triangular shaped post 64 stands out at the end 47. A fifth member 54 with a selective circular shape in cross-section joins the member 41 at the extension 42, with the centerline D parallel to the plane D, perpendicular to the main body 44 and 46. The member 48 also joins the member 54 at a position 55 adjacent to its connection to the member 41 at the extension 42. A cylindrical post 56 sits at an end 57 of the member 54, next to the connection of the member 41 to the member 54. A cylindrical post 58 sits at the end 59 of the member 54, opposite to the end of 57. The post 56 and 58 are co-centered, and centered to the centerline D. The post 55, 58 have smaller radius than that of the member 54, thus their connection to the member 54 forms a shoulder 60 next to the post 56, a shoulder 61 next to the post 58. In one embodiment, the member 54 has a plurality of teeth 62 about the centerline D (FIG. 9). The plurality of teeth 62 is selectively located, along the centerline D, closely to the member 41 in the area where the member 48 joins the member 54; and in a general area towards the member 41 and 45.

When the inertia lever 5 is installed onto the chassis 4, the posts 56, 58 are kept in the holes 37, 38 of the chassis respectively, forming a pivot axis 70. The centerline C and the centerline D overlap each other. The pivot axis 70 is in line with both the centerline C and the centerline D. Thus the inertia lever 5 is pivotally supported on the chassis 4, with the majority of it, including main body 44, 46, appearing in the general area between the end portion 21 and the end portion 23 of the chassis 4(FIG. 3, FIG. 4). This indicates that the center of mass 79 of the inertia lever 5 is to the left of the pivot axle 70 (FIG. 15).

Since both the centerline B and the centerline C are perpendicular to the plane C, the centerline B and the centerline C are parallel to each other. Thus the pivot axle 69 and the pivot axle 70 are parallel to each other.

Figure 13:
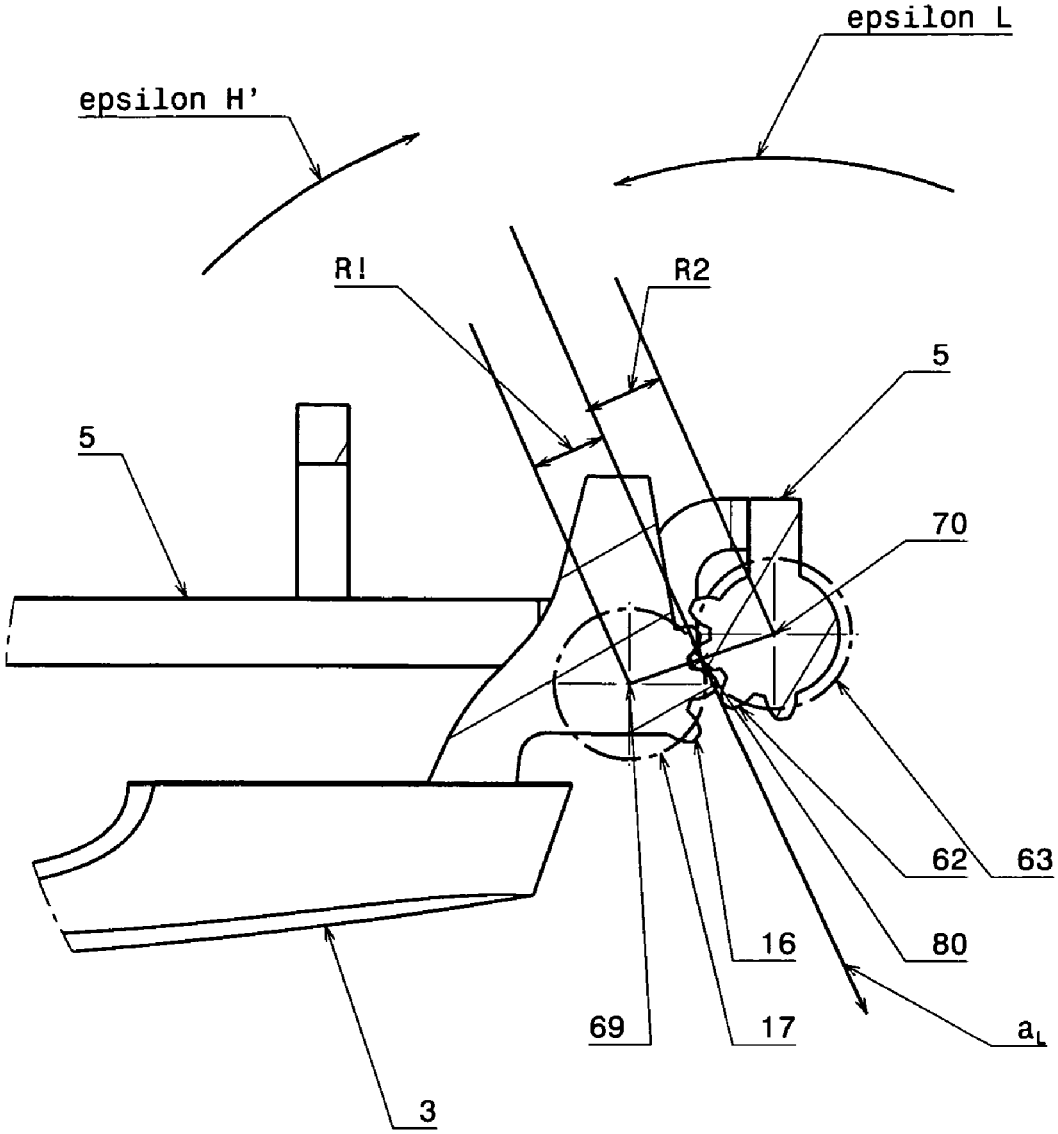
FIG. 13 is a horizontal section along line F-F of FIG. 5 showing coupling of the handle and the inertia lever according to the embodiment of the invention.

In one embodiment, the inertia lever 5 is installed onto the chassis 4 with its members 41, 45 towards the chassis 4 for its plurality of teeth 62 to engage the plurality teeth 16 on the handle 3 (FIG. 2, FIG. 3 and FIG. 13). With the post 56 through the hole 37 and the pot 58 through the hole 38, the inertia lever rotates about the pivot axle 70. The shoulder 60 rests against the wall 34, the shoulder 61 rests against the wall 36.

The spring 6 is installed on the member 57, with one of its leg 65 siting against the bracket 33 and the other leg 66 siting against the post 64 (FIG. 2). The spring 6 provides bias to the inertia lever 5 to keep it, as well as the handle 3 to the rest position when the handle 3 is not pulled (FIG. 14).

Referring to FIG. 13, after installation the plurality teeth 16 engage the plurality teeth 62. In this fashion, the handle 3 and the inertia lever 5 are coupled with each other, e.g. pulling handle 3 will cause inertia lever 5 to rotate in the opposite direction to that of the handle 3. FIG. 14 shows that the inertia lever 5 rotates clockwise when the handle 3 is pulled and rotates counterclockwise. The plurality f teeth 16 and the plurality of teeth 62 are engaged with each other all the time, e.g. during normal operation of the handle assembly 101 and during side impact crash, thus the handle 3 and the inertia lever are directly coupled in one embodiment. It is appreciated that the coupling of the handle 3 to the inertia lever 5 may take different form than that of the plurality of teeth 16, 62. It is also appreciated that the handle 3 may be fixedly assembled to a third component, the third component may be pivotally assembled to the chassis 4 and coupled to the inertia lever 5.

Figure 16:
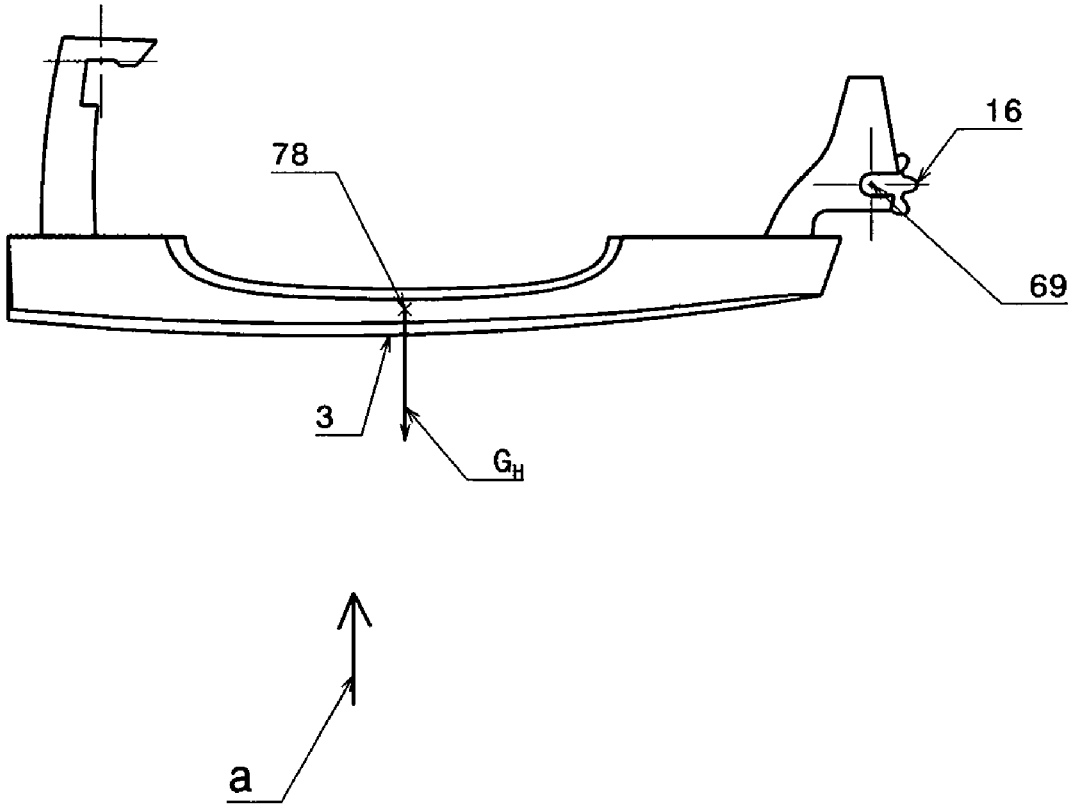
FIG. 16 is a top view of the handle.

Referring to FIG. 16, the side impact is represented by an acceleration a. The handle 3 is subjected to an inertia force $G_H$ acting on the handle 3's center of mass 78 due to its mass $m_H$ and the acceleration a:

$$G_H=-m_H*a,$$

minus sign '−' in front of $m_H*a$ indicates that the inertia force $G_H$ is in opposite direction of the acceleration a.

Figure 25:
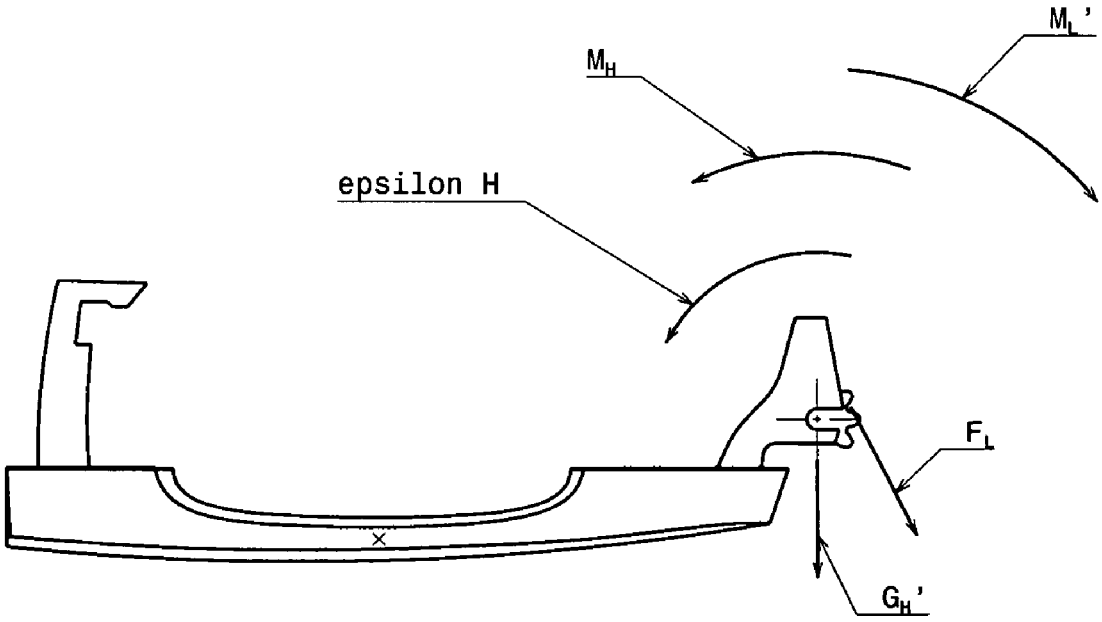
FIG. 25 is a top view of the handle.

Referring to FIG. 25, the handle 3 being constrained by the pivot axle 69, the inertia force $G_H$ on the handle 3 is transformed into a force $G_H'$ acting at the location of the pivot axle 69 and a moment of momentum $M_H$ about the pivot axle 69 per the shifting theorem of force:

$$G_H'=-m_H*a$$

$$M_H=J_H*\epsilon_H.$$

$J_H$ is defined as the handle 3's inertia moment about the pivot axle 69. The inertia moment of a rigid body about its pivot axle, e.g. handle, is associated with the rigid body's mass, size, and shape, and is calculated with the mathematical formula:

$$J=\int r^2*dm,$$

dm is a small portion of mass of the rigid body r is the distance from the pivot axle to the small portion of mass $\int$ is integration operation.

$\epsilon_H$ is defined as the angular acceleration of the handle 3 about the pivot axle 69.

The moment $M_H$ causes the handle 3 to rotate counterclockwise, and to rotate inadvertently to open position.

Figure 17:
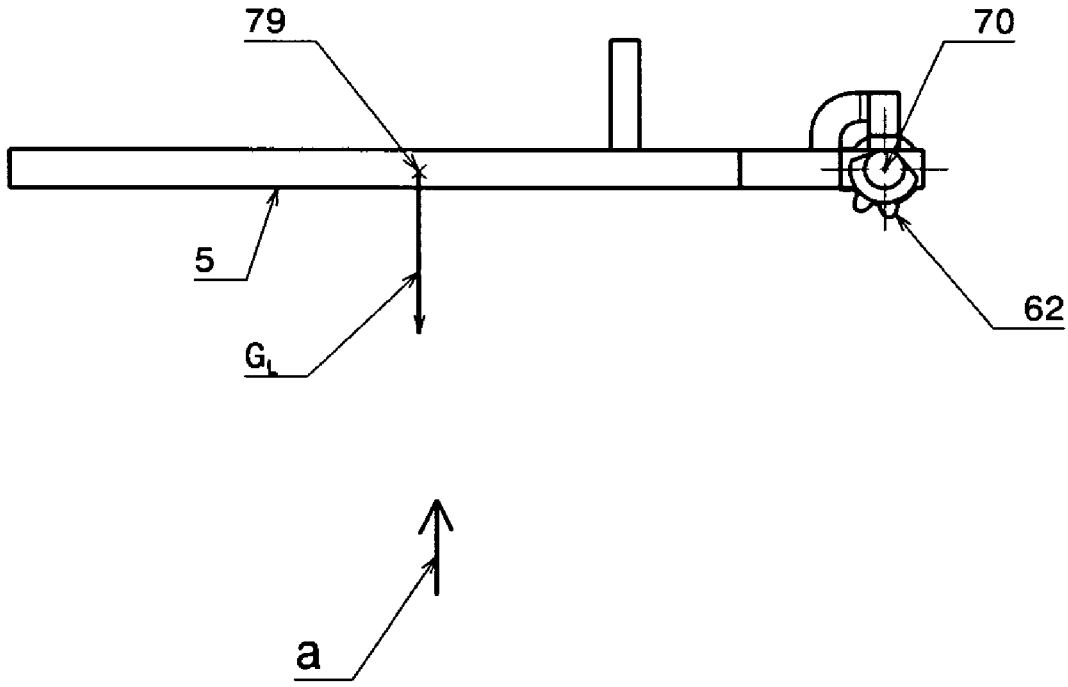
FIG. 17 is a top view of the inertia lever.

Referring to FIG. 17, the inertia lever 5 is also subjected to an inertia force $G_L$ acting on the inertia lever 5's center of mass 79 due to its mass $m_L$ and the acceleration a:

$$G_L=-m_L*a$$

Figure 26:
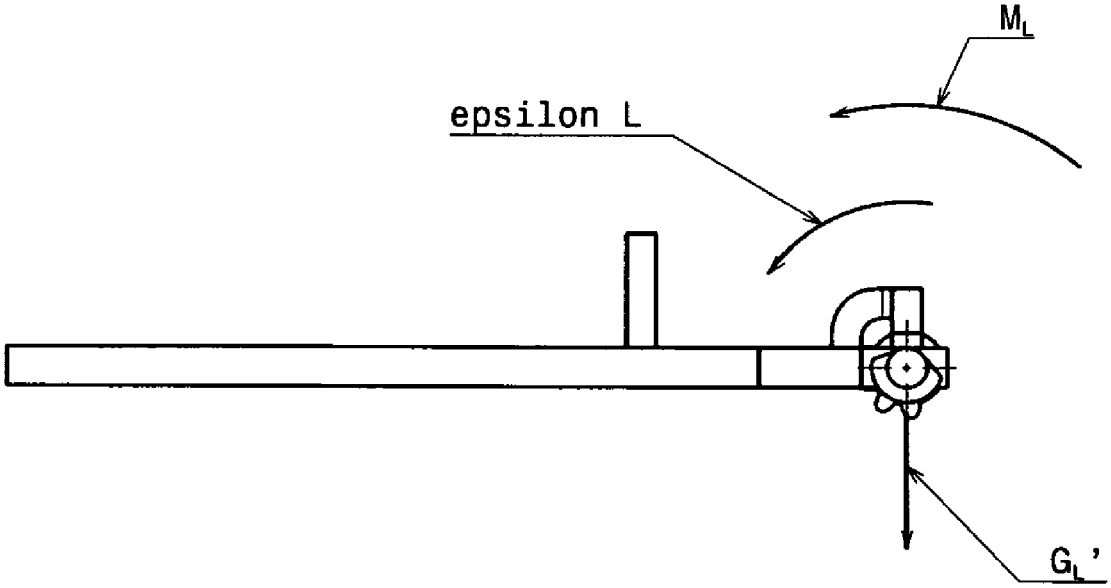
FIG. 26 is a top view of the inertia lever.

Referring to FIG. 26, the inertia lever 5 being constrained by the pivot axle 70, the inertia force $G_L$ on the inertia lever is transformed into a force $G_L'$ acting at the location of the pivot axle 70 and a moment of momentum $M_L$ about the pivot axle 70 per the shifting theorem of force:

$$G_L'=-m_L*a$$

$$M_L=J_L*\epsilon_L.$$

$J_L$ is defined as the inertia lever 5's inertia moment about the pivot axle 70. $\epsilon_L$ is defined as the angular acceleration of the inertia lever 5 about the pivot axle 70. The moment $M_L$ causes the inertia lever 5 to rotate counterclockwise.

Referring to FIGS. 13 and 25, in the meshing of the plurality of teeth 16 and 62, there is a contact point 80 between a tooth of the plurality of teeth 16 and a tooth of the plurality of teeth 62 at a particular moment of time. R1 is the distance from the contact point 80 to the pivot axle 69, R2 is the distance from the contact 80 to the pivot axle 70. At the contact point 80 at this moment of time, the tooth of the plurality of teeth 62 applies a force $F_L$ on the tooth of the plurality of teeth 16 caused by the moment of momentum $M_L$:

$$F_L=M_L/R2$$

The handle 3 being constrained by the pivot axle 69, the force $F_L$ is transformed into a moment $M_L'$:

$$M_L'=F_L*R1=M_L*R1/R2$$

$M_L'$ can be seen as the moment of momentum $M_L$ being transferred on to the handle via the mesh of the plurality of teeth 16, 62. The moment $M_L'$ causes the handle 3 to rotate clockwise.

The resultant of the moments on the handle 3 is:

$$\text{resultant}=M_H+M_L'$$

If the moment $M_L'$ is not parallel to the moment $M_H$, its component which is parallel to the moment $M_H$ will be used in the above calculation. Because $M_L'$ is opposite in direction to $M_H$, then $$\text{resultant}=M_H+M_L'<M_H$$

Thus the resultant of the moments resultant is smaller than the moment $M_H$. The effect of the resultant causing the handle 3 to rotate inadvertently to open position is reduced in comparison to that of the moment $M_H$.

Constructing the inertia lever 5 with selection of its mass, size, and shape in terms of its inertia moment, and particularly, $$J_L=J_H*(R2/R1)^2,$$

there is:

$$\begin{aligned}\text{resultant} &= M_H + M_L' \\ &= M_H + M_L*(R1/R2) \\ &= J_H*\varepsilon_H + J_L*\varepsilon_L*(R1/R2) \\ &= J_H*\varepsilon_H + J_H*(R2/R1)^2*\varepsilon_L*(R1/R2) \\ &= J_H*\varepsilon_H + J_H*\varepsilon_J*(R2/R1)\end{aligned}$$

Referring to FIG. 13, a linear acceleration $a_L$ at the contact point 80 can be calculated with angular acceleration on each of the two meshing members and the distance from the contact point to the pivot axle of the respective meshing member:

$$a_L=R1*\epsilon_H'=R2*\epsilon_L,$$

and $$\epsilon_H'=-\epsilon_H,$$

then $$\begin{aligned}\text{resultant} &= M_H + M_L' \\ &= J_H*\varepsilon_H + J_H*\varepsilon_H' \\ &= J_H*\varepsilon_H - J_H*\varepsilon_H = 0\end{aligned}$$

The net effect of the resultant of the moments on the handle 3 is zero and the handle 3 does not rotate inadvertently to open position under the side impact.

Without the need of large and heavy counter weight in the bell crank lever to counteract the inertia force on the handle, the bell crank lever being part of latch activation mechanism 103 in this case, the bell crank lever can be made with much less weight and stands little chance to rotate and unlatch the latch under the vertical component of the inertia force.

FIGS. 18-23 illustrate yet another embodiment for a directly coupled-inertia activated mechanism.

Figure 18:
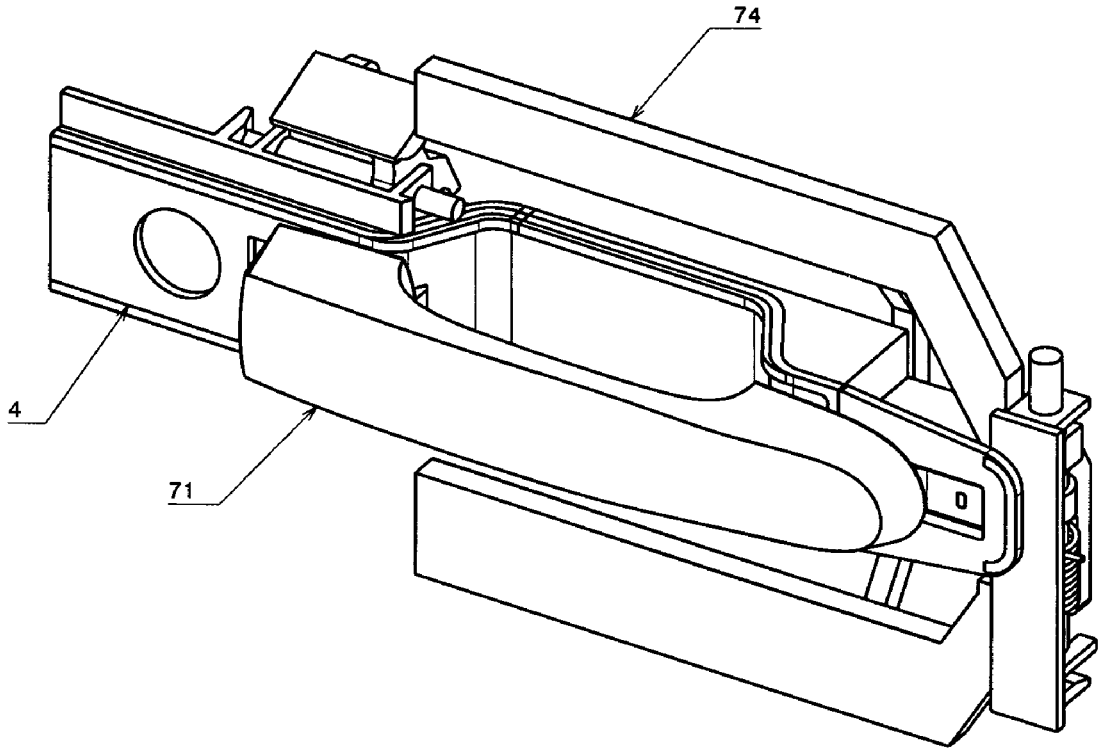
FIG. 18 is a perspective view of the door handle assembly according to another embodiment of the invention.
Figure 19:
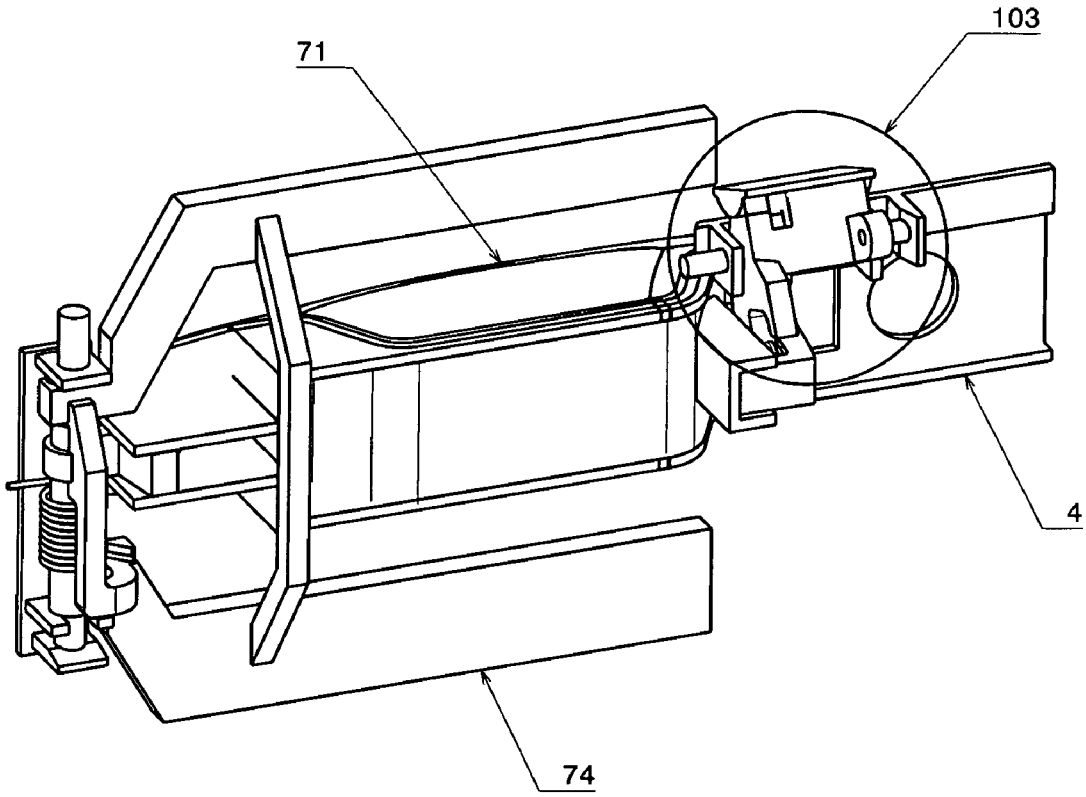
FIG. 19 is another perspective view of the door handle assembly of FIG. 18.
Figure 20:
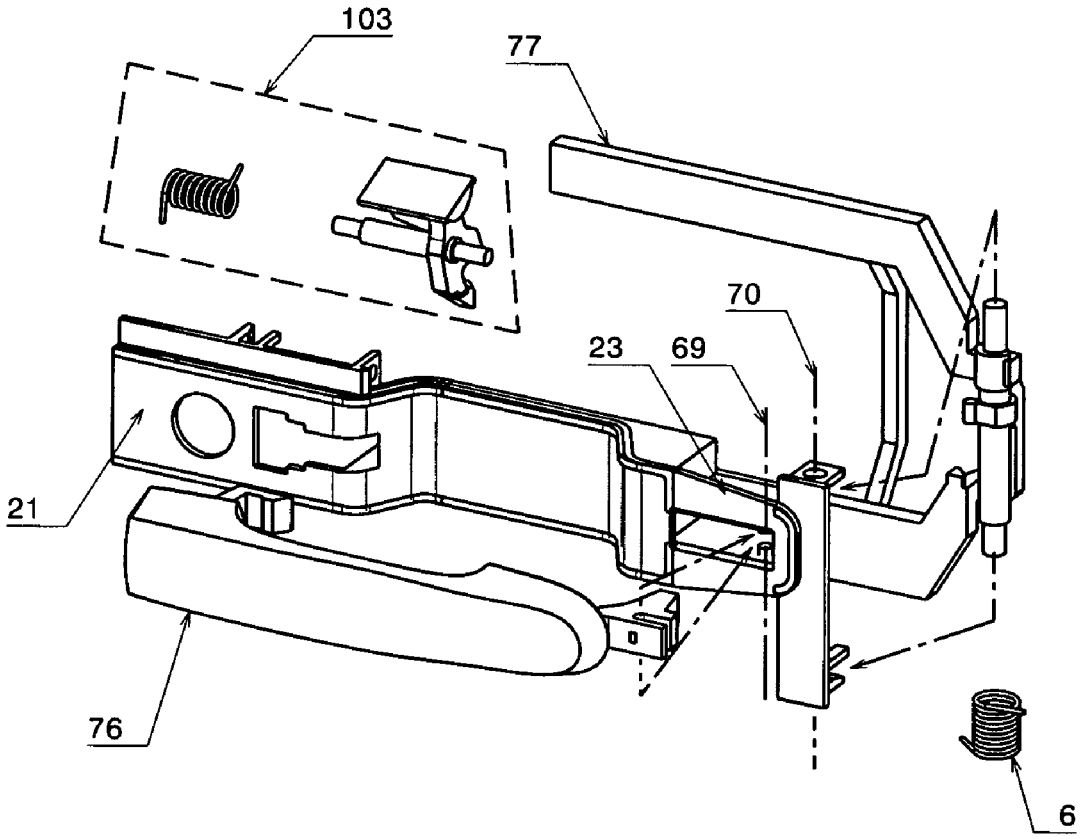
FIG. 20 is an exploded view of the door handle assembly of FIG. 18.

Referring to FIG. 18, FIG. 19, and FIG. 20, the door handle assembly 102 comprises a handle 76, a chassis 4, a latch activation mechanism 103, an inertia lever 77, in one embodiment.

Figure 21:
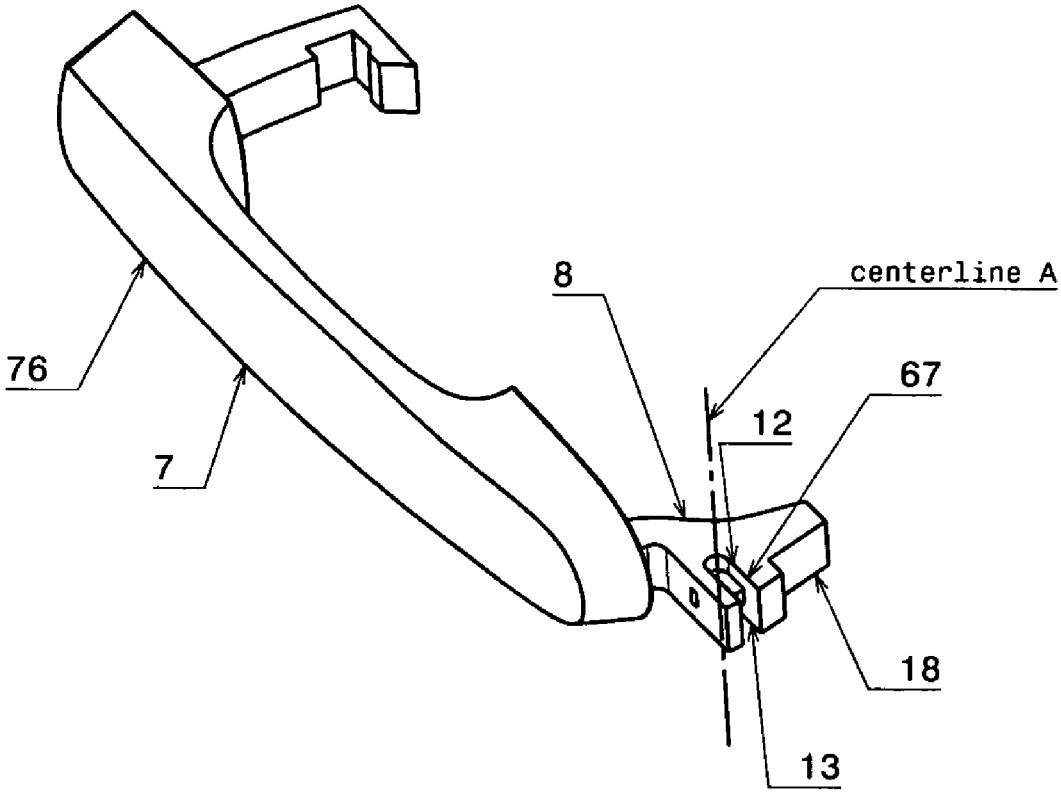
FIG. 21 is a perspective view of a handle with its features according to another embodiment of the invention.

Referring to FIG. 21, a handle 76 has the same construction of the handle 3. However, it does not have the plurality of teeth 16, it has a slot 67 which can be an extension of the notch 12 and 13 of the handle 3 in another embodiment.

Figure 22:
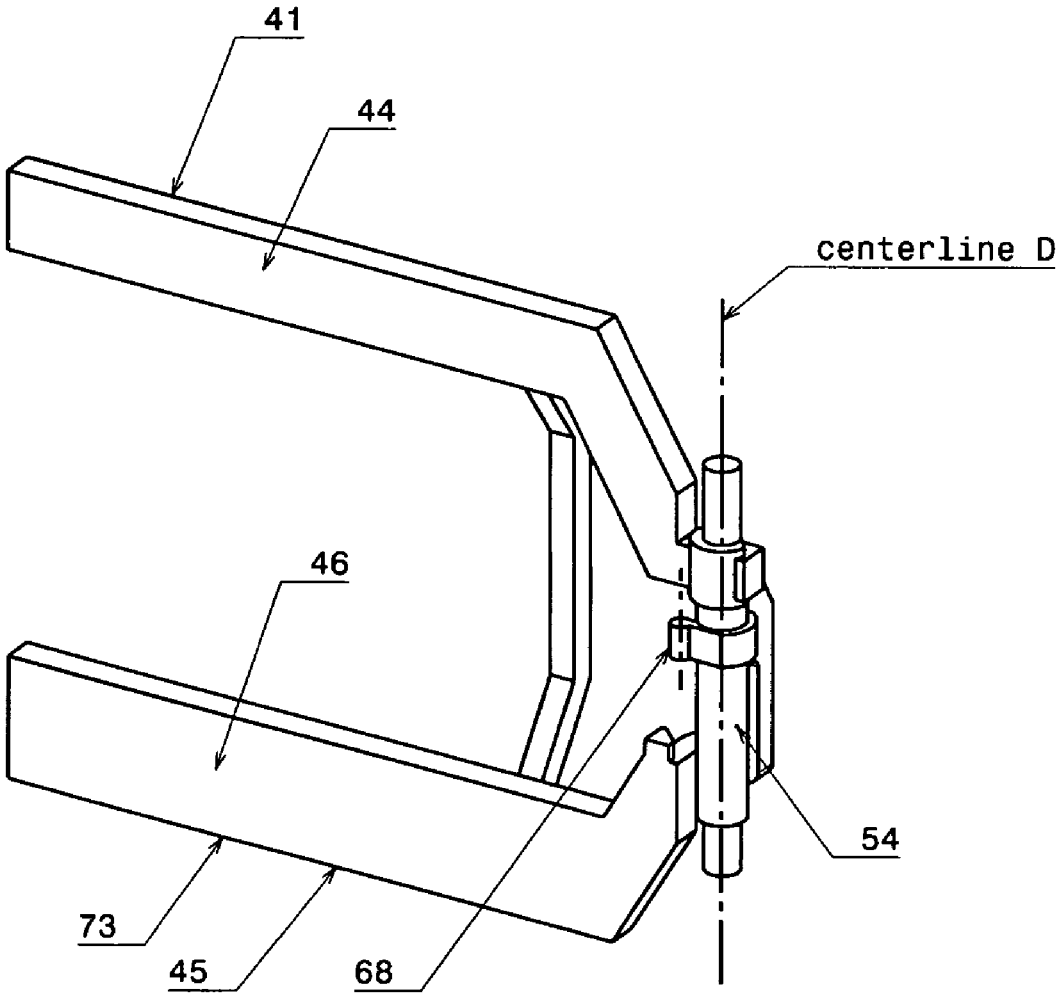
FIG. 22 is a perspective view of an inertia lever with its features according to the other embodiment of the invention.

Referring to FIG. 22, an inertia lever 77 has the same construction of the inertia lever 5. However, it does not have the plurality of teeth 62, it has a post 68 connected to the member 54 in the other embodiment.

Figure 24:
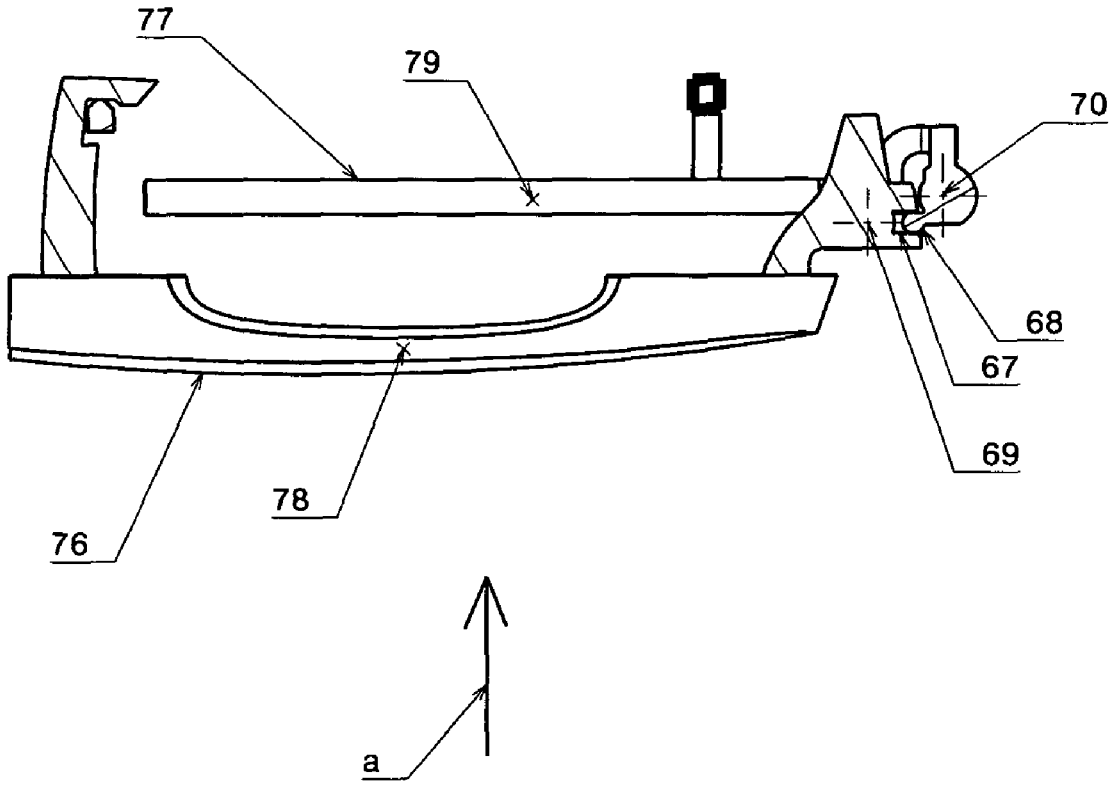
FIG. 24 is a top view of the door handle assembly of FIG. 18 showing the handle and the inertia lever being installed.

When the handle 76 is installed onto the chassis 4, the notches 12, 13 catch the posts 28, 29 of the chassis 4, forming a pivot axis 69. The centerline A and the centerline B overlap each other. Pivot axis 69 is in line with both the centerline A and the centerline B. Thus the handle 76 is pivotally supported on the chassis 4, with the body 7 appearing in the general area between the end portion 21 and the end portion 23 of the chassis 4 (FIG. 20). This indicates that the center of mass 78 of the handle 76 is to the left of the pivot axle 69 (FIG. 24).

When the inertia lever 77 is installed onto the chassis 4, the posts 56, 58 are kept in the holes 37, 38 of the chassis respectively, forming a pivot axis 70. The centerline C and the centerline D overlap each other. The pivot axis 70 is in line with both the centerline C and the centerline D. Thus the inertia lever 77 is pivotally supported on the chassis 4, with the main body 44, 46 appearing in the general area between the end portion 21 and the end portion 23 of the chassis 4(FIG. 20). This indicates that the center of mass 79 of the inertia lever 77 is to the left of the pivot axle 70 (FIG. 24).

Figure 23:
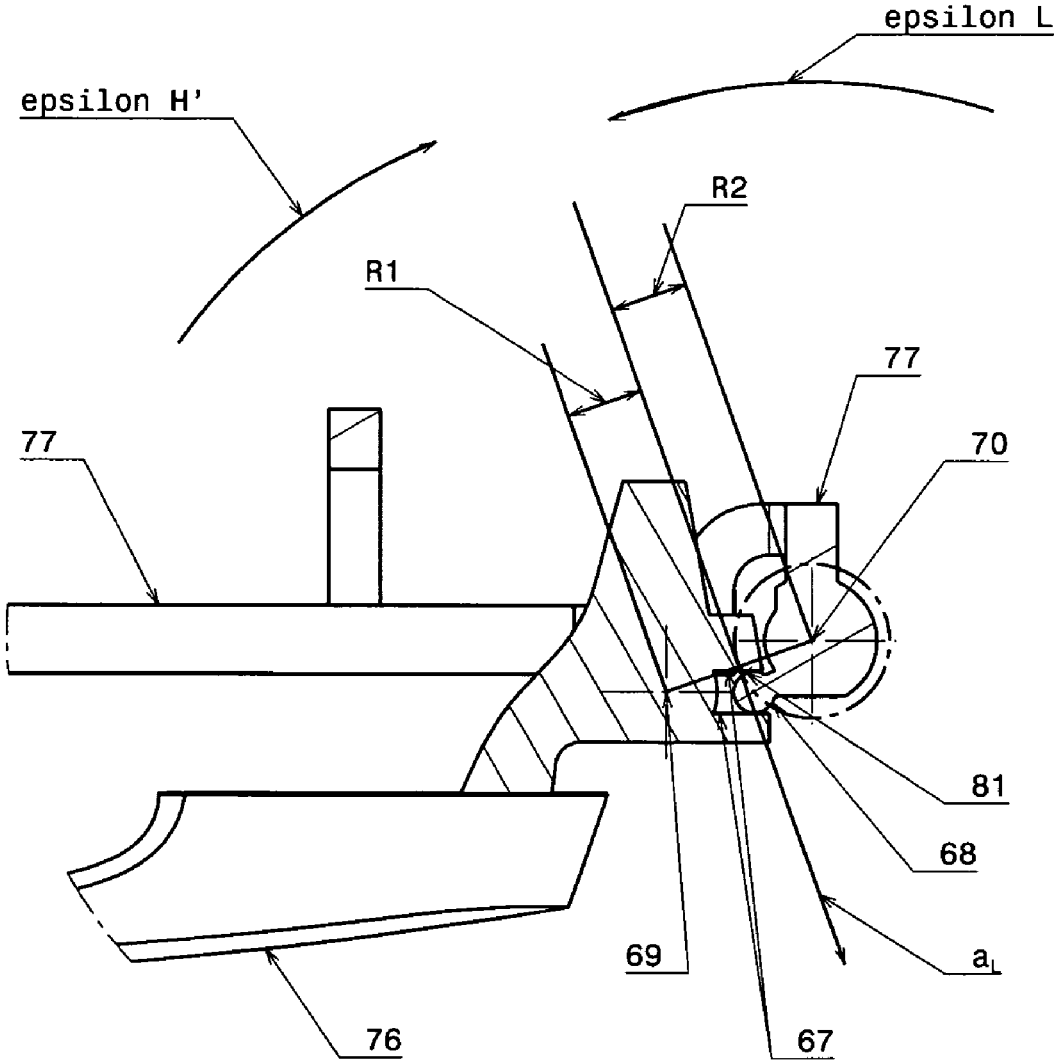
FIG. 23 is a horizontal section along line F-F of FIG. 5 showing coupling of the handle and the inertia lever according to the other embodiment of the invention.

Referring to FIG. 23, after installation, the slot 67 of the handle 76 engages the post 68 of the inertia lever 77. In this fashion, the handle 76 and the inertia lever 77 are coupled with each other, e.g. pulling handle 76 will cause inertia lever 77 to rotate in the opposite direction to that of the handle 76. The post 68 and the slot 67 are engaged with each all the time, e.g. during normal operation of the handle assembly 102 and during side impact crash, thus the handle 76 and the inertia lever are directly coupled in another embodiment.

Figure 27:
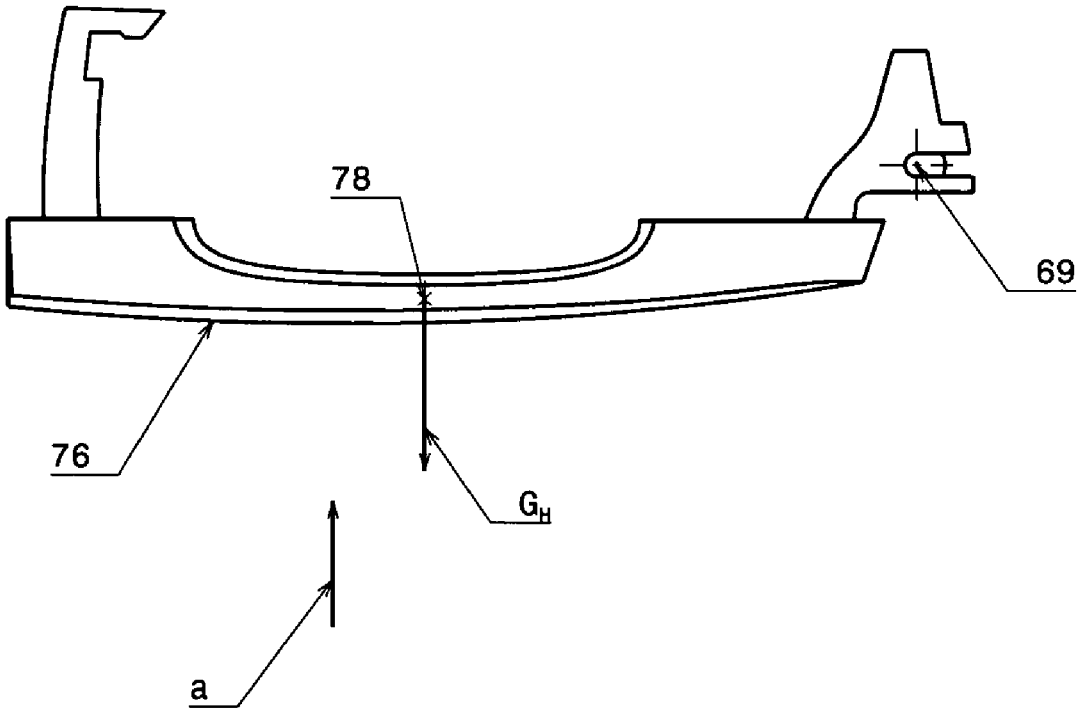
FIG. 27 is a top view of the handle according to the other embodiment of the invention.

Referring to FIG. 27, the side impact is represented by an acceleration a. The handle 76 is subjected to an inertia force $G_H$ acting on the handle 76's center of mass 78 due to its mass $m_H$ and the acceleration a:

$$G_H=-m_H*a,$$

minus sign '–' in front of $m_H*a$ indicates that the inertia force $G_H$ is in opposite direction of the acceleration a.

Figure 28:
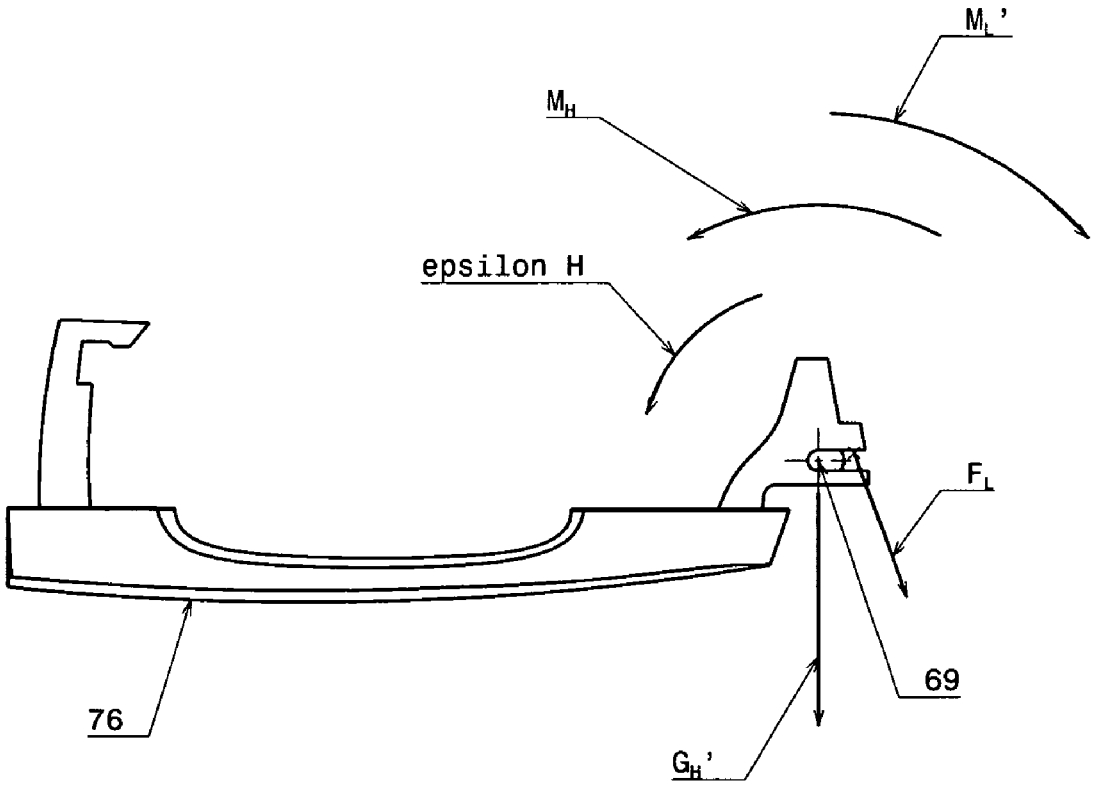
FIG. 28 is a top view of the handle according to the other embodiment of the invention.

Referring to FIG. 28, the handle 76 being constrained by the pivot axle 69, the inertia force $G_H$ on the handle 76 is transformed into a force $G_H'$ acting at the location of the pivot axle 69 and a moment of momentum $M_H$ about the pivot axle 69 per the shifting theorem of force:

$$G_H'=-m_H*a$$

$$M_H=J_H*\epsilon_H.$$

$J_H$ is defined as the handle 76's inertia moment about the pivot axle 69. $\epsilon_H$ is defined as the angular acceleration of the handle 76 about the pivot axle 69.

The moment $M_H$ causes the handle 76 to rotate counterclockwise, and to rotate inadvertently to open position.

Figure 29:
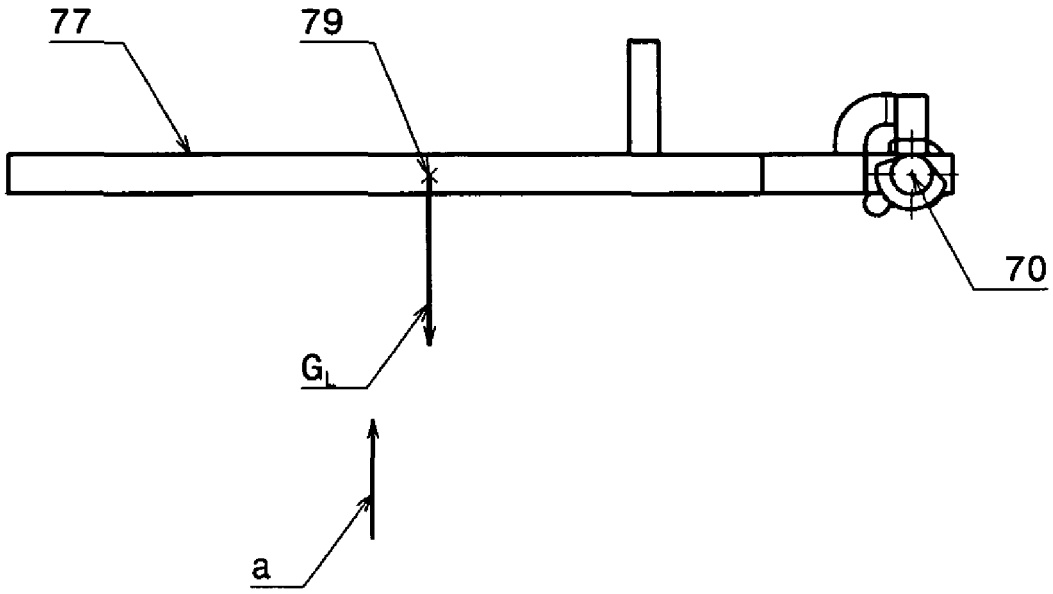
FIG. 29 is a top view of the inertia lever according to the other embodiment of the invention.

Referring to FIG. 29, the inertia lever 77 is also subjected to an inertia force $G_L$ acting on the inertia lever 77's center of mass 79 due to its mass $m_L$ and the acceleration a:

$$GL=-m_L*a$$

Figure 30:
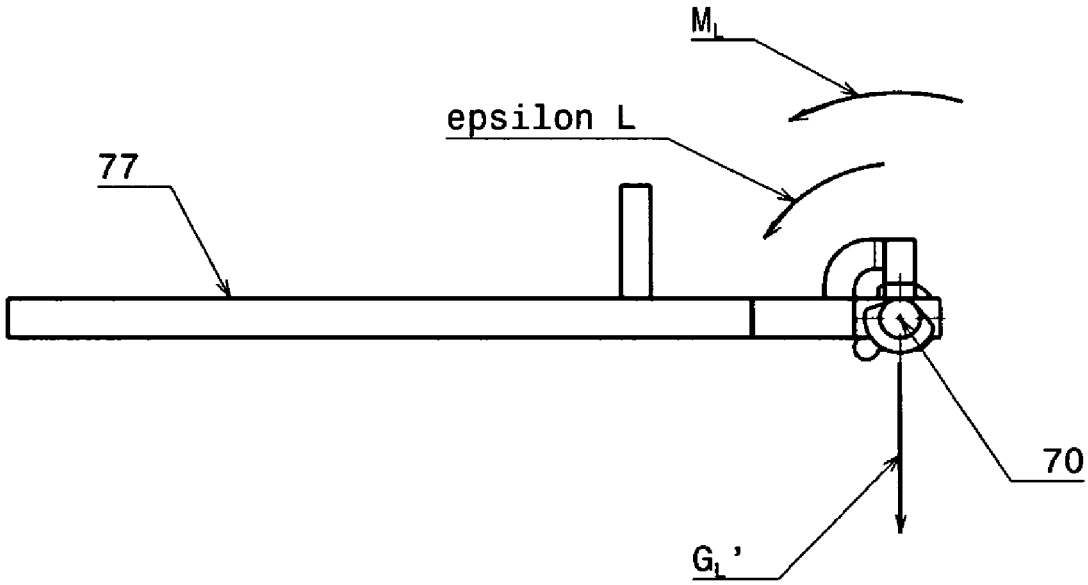
FIG. 30 is a top view of the inertia lever according to the other embodiment of the invention.

Referring to FIG. 30, the inertia lever 77 being constrained by the pivot axle 70, inertia force $G_L$ on the inertia lever is transformed into a force $G_L'$ acting at the location of the pivot axle 70 and a moment of momentum $M_L$ about the pivot axle 70 per the shifting theorem of force:

$$G_L'=-m_L*a$$

$$M_L=J_L*\epsilon_L.$$

$J_L$ is defined as the inertia lever 77's inertia moment about the pivot axle 70. $\epsilon_L$ is defined as the angular acceleration of the inertia lever 77 about the pivot axle 70. The moment $M_L$ causes the inertia lever 77 to rotate counterclockwise.

Referring to FIGS. 23 and 28, in the meshing of the slot 67 and the post 68, there is a contact point 81 between the slot 67 and the post 68 at a particular moment of time. R1 is the distance from the contact point 81 to the pivot axle 69, R2 is the distance from the contact 81 to the pivot axle 70. At the contact point 81 at this moment of time, the post 68 applies a force $F_L$ on the slot 67 caused by the moment of momentum $M_L$:

$$F_L=M_L/R2$$

The handle 76 being constrained by the pivot axle 69, the force $F_L$ is transformed into a moment $M_L'$:

$$M_L'=F_L*R1=M_L*R1/R2$$

$M_L'$ can be seen as the moment of momentum $M_L$ being transferred on to the handle 76 via the mesh of the slot 67 and the post 68. The moment $M_L'$ causes the handle 76 to rotate clockwise.

The resultant of the moments on the handle 76 is:

$$\text{resultant}=M_H+M_L'$$

If the moment $M_L'$ is not parallel to the moment $M_H$, its component which is parallel to the moment $M_H$ will be used in the above calculation. Because $M_L'$ is opposite in direction to $M_H$, then $$\text{resultant}=M_H+M_L'<M_H$$

Thus the resultant of the moments resultant is smaller than the moment $M_H$. The effect of the resultant causing the handle 76 to rotate inadvertently to open position is reduced in comparison to that of the moment $M_H$.

Constructing the inertia lever 77 with selection of its mass, size, and shape in terms of its inertia moment, and particularly, $$J_L=J_H*(R2/R1)^2,$$

there is:

$$\begin{aligned}\text{resultant} &= M_H + M_L' \\ &= M_H + M_L*(R1/R2) \\ &= J_H*\varepsilon_H + J_L*\varepsilon_L*(R1/R2) \\ &= J_H*\varepsilon_H + J_H*(R2/R1)^2*\varepsilon_L*(R1/R2) \\ &= J_H*\varepsilon_H + J_H*\varepsilon_J*(R2/R1)\end{aligned}$$

Referring to FIG. 23, a linear acceleration $a_L$ at the contact point 81 can be calculated with angular acceleration on each of the two meshing members and the distance from the contact point to the pivot axle of the respective meshing member:

$$a_L=R1*\epsilon_H'=R2*\epsilon_L,$$

and $$\epsilon_H'=-\epsilon_H,$$

then $$\begin{aligned}\text{resultant} &= M_H + {}_{ML'} \\ &= J_H*\varepsilon_H + J_H*\varepsilon_H' \\ &= J_H*\varepsilon_H - J_H*\varepsilon_H = 0\end{aligned}$$

The net effect of the resultant of the moments on the handle 76 is zero and the handle 76 does not rotate inadvertently to open position under the side impact.

What is claimed is:

1. A door handle assembly with directly coupled-inertia activated mechanism, comprising:

(a) a chassis which is to be installed in a vehicle door;

(b) a handle which is pivotally supported on said chassis and is able to rotate about a pivot axle, one direction of rotation causes said vehicle door to be unlatched and open as understood by those skilled in the art;

(c) an inertia lever which is pivotally supported on said chassis and is able to rotate about a second pivot axle;

(d) said handle has a set of engagement features;

(e) said inertia lever has a set of engagement features;

(f) a coupling wherein through interaction between said set of engagement features on said handle and said set of engagement features on said inertia lever, said inertia lever rotates about said second pivot axle oppositely to said handle when said handle rotates about said first pivot axle;

(g) said handle has an inertia moment relative to said first pivot axle, said inertia moment of said handle is associated to size, shape, and mass of said handle;

(h) said inertia lever has an inertia moment relative to said second pivot axle, said inertia moment of said inertia lever is associated to size, shape, and mass of said inertia lever;

(i) a biasing means which keeps said inertia lever at a rest position;

(j) said handle's center of mass is on one general side of said first pivot axle;

(k) said inertia lever's center of mass is on said general side of second pivot axle;

wherein said handle is subjected to an inertia force acting on said handle's center of mass due to said handle's mass and the side impact in concern; said inertia force on said handle is transformed into a first force acting at the location of said first pivot axle, and a first moment of momentum acting on said handle as said handle is constrained by said first pivot axle; said first moment of momentum causes said handle to rotate in a first rotational direction about said first axle and has a magnitude of a product of said inertia moment of said handle and a first angular acceleration of said handle about said first axle; said first moment causes said handle to rotate inadvertently to a open position;

said inertia lever is subjected to an inertia force acting on said inertia lever's center of mass due to said inertia lever's mass and the side impact in concern; said inertia force on said inertia lever is transformed into a second force acting at the location of said second pivot axle, and a second moment of momentum acting on said inertia lever as said inertia lever is constrained by said second pivot axle; said second moment of momentum causes said inertia lever to rotate in said first rotational direction about said second pivot axle and has a magnitude of a product of said inertia moment of said inertia lever and a second angular acceleration of said of said inertia lever about said second pivot axle;

said second moment of momentum is transferred onto said handle as a third moment via said coupling; said third moment causes said handle to rotate in a second rotational direction about said first pivot axle; said second rotational direction is opposite to said first rotational direction;

a resultant of said first moment of momentum and said third moment on said handle has a magnitude of $$M=M_H+M_L'<M_H$$

M is said resultant $M_H$ is said first moment of momentum $M_L'$ is said third moment said resultant causes said handle to rotate inadvertently to said open position with smaller magnitude than said magnitude of said first moment of momentum.

2. The door handle assembly with directly coupled-inertia activated mechanism as set forth in claim 1, wherein said handle has a plurality of teeth about said first pivot axle as said engagement features on said handle for said coupling.

3. The handle assembly with directly coupled-inertia activated mechanism as set forth in claim 1 wherein said first pivot axle and said second pivot axle are parallel to each other.

4. The handle assembly with directly coupled-inertia activated mechanism as set forth in claim 1 wherein said inertia lever has a plurality a teeth about said second pivot axle as said engagement features on said inertia lever for said coupling.

5. The handle assembly with directly coupled-inertia activated mechanism as set forth in claim 1 wherein a spring acts as said biasing means for said inertia lever.

6. A door handle assembly with directly coupled-inertia activated mechanism, comprising:

(a) a chassis which is to be installed in a vehicle door;

(b) a handle which is pivotally supported on said chassis and is able to rotate about a first pivot axle, one direction of rotation causes said vehicle door to be unlatched and open as understood by those skilled in the art;

(c) said handle's center of mass is on one general side of said first pivot axle;

(d) an inertia lever which is pivotally supported on said handle and is able to rotate about a second pivot axle;

(e) said inertia lever's center of mass is on said general side of said second pivot axle;

(f) said handle has a set of engagement features;

(g) said inertia lever has a set of engagement features;

(h) a coupling wherein through interaction between said set of engagement features on said handle and set of engagement features on said inertia lever, said inertia lever rotates about said second pivot axle oppositely to said handle when said handle rotates about said first axle;

(i) said coupling wherein said set of engagement features on said handle makes contact with said set of engagement features on said inertia lever; a first distance from said contact to said first pivot axle; a second distance from said contact to said second pivot axle;

(j) said handle has an inertia moment relative to said first pivot axle; said inertia moment of said handle is associated to size, shape, and mass of said handle and can be calculated from:

$$J_H=\int r^2*dm$$

$J_H$ is said inertia moment of said handle $\int$ is integration operation dm is a small portion of mass of said handle r is the distance from said first pivot axle to said small portion of mass (k) said inertia has an inertia moment relative to said second pivot axle; said inertia moment of said inertia lever is associated to size, shape, and mass of said handle and can be calculated from:

$$J_L=\int r^2*dm$$

$J_L$ is said inertia moment of said inertia lever $\int$ is integration operation dm is a small portion of mass of said inertia lever r is the distance from said second pivot axle to said small portion of mass (l) a biasing means which keeps said inertia lever at a rest position;

(m) said second pivot axle is parallel to said first pivot axle; wherein said handle is subjected to an inertia force acting on said handle's center of mass due to said handle's mass and the side impact in concern; said inertia force on said handle is transformed into a first force acting at the location of said first pivot axle, and a first moment of momentum acting on said handle as said handle is constrained by said first pivot axle; said first moment of momentum causes said handle to rotate in a first rotational direction about said first axle and has a magnitude of a product of said inertia moment of said handle and a first angular acceleration of said handle about said first axle; said first moment causes said handle to rotate inadvertently to a open position:

$$M_H=J_H*\epsilon_H$$

$M_H$ is said first moment of momentum $J_H$ is said inertia moment of said handle $\epsilon_H$ is said first angular acceleration said inertia lever is subjected to an inertia force acting on said inertia lever's center of mass due to said inertia lever's mass and the side impact in concern; said inertia force on said inertia lever is transformed into a second force acting at the location of said second pivot axle, and a second moment of momentum acting on said inertia lever as said inertia lever is constrained by said second pivot axle; said second moment of momentum causes said inertia lever to rotate in said first rotational direction about said second pivot axle and has a magnitude of a product of said inertia moment of said inertia lever and a second angular acceleration of said of said inertia lever about said second pivot axle:

$$M_L=J_L*\epsilon_L$$

$M_L$ is said a second moment of momentum $J_L$ is said inertia moment of said inertia lever $\epsilon_L$ is said second angular acceleration at said contact, said engagement features of said inertia lever applies a force on said set of engagement features of said handle; said force is caused by said second moment of momentum:

$$\text{said force}=M_L/R2$$

R2 is said second distance said force is transformed into a third moment as said handle is constrained by said first pivot axle; said third moment causes said handle to rotate in a second rotational direction about said first pivot axle; said second rotational direction is opposite to said first rotational direction; said third moment has a magnitude of $$\begin{aligned} M_L' &= \text{said force} * R1 \\ &= M_L * (R1/R2) \end{aligned}$$

$M_L'$ is said third moment

R1 is said first distance a resultant of said first moment of momentum and said third moment on said handle has a magnitude of $$M=M_H+M_L'<M_H$$

said resultant causes said handle to rotate inadvertently to said open position with smaller magnitude than said magnitude of said first moment of momentum.

7. The door handle assembly with directly coupled-inertia activated mechanism as set forth in claim 6, wherein said handle has a plurality of teeth about said first pivot axle as said engagement features on said handle for said coupling.

8. The handle assembly with directly coupled-inertia activated mechanism as set forth in claim 6, wherein said inertia lever has a plurality of teeth about said second pivot axle as said engagement features on said inertial lever for said coupling.

9. The handle assembly with directly coupled-inertia activated mechanism as set forth in claim 6, wherein a spring acts as the biasing means for said inertia lever.

10. The handle assembly with directly coupled-inertia activated mechanism as set forth in claim 6, wherein a linear acceleration at said contact at a time is product of angular acceleration of each of said two interacting set of engagement features and said distance from said contact point to said pivot axle of respective said interacting set of engagement features:

$$a_L=\epsilon_H'*R1=\epsilon_L*R2,$$

and $\epsilon_H'=-\epsilon_H$ $a_L$ is said linear acceleration at said contact said inertia lever is constructed with selection of size, mass, and shape in terms of said inertia moment of said inertia lever such that:

$$J_L=J_H*(R2/R1)^2,$$

there is $$\begin{aligned} M &= M_H + M_L' \\ &= M_H + M_L*(R1/R2) \\ &= J_H*\varepsilon_H + J_L*\varepsilon_L*(R1/R2) \\ &= J_H*\varepsilon_H + J_H*\varepsilon_L*(R2/R1) \\ &= J_H*\varepsilon_H + J_H*\varepsilon_H' \\ &= J_H*\varepsilon_H - J_H*\varepsilon_H = 0 \end{aligned}$$

said resultant of said first moment of momentum and said third moment on said handle is zero; said handle does not rotate inadvertently to said open position under the side impact in concern.

* * * * *